US008107639B2

(12) United States Patent
Moeller et al.

(10) Patent No.: US 8,107,639 B2
(45) Date of Patent: Jan. 31, 2012

(54) SYSTEM AND METHOD FOR A SOUND MASKING SYSTEM FOR NETWORKED WORKSTATIONS OR OFFICES

(75) Inventors: Niklas Moeller, Oakville (CA); Allen Bryce Taylor, Hamilton (CA)

(73) Assignee: 777388 Ontario Limited, Ontario (CA)

( * ) Notice: Subject to any disclaimer, the term of this patent is extended or adjusted under 35 U.S.C. 154(b) by 1219 days.

(21) Appl. No.: 11/477,973

(22) Filed: Jun. 29, 2006

(65) Prior Publication Data

US 2008/0002836 A1 Jan. 3, 2008

(51) Int. Cl.
*H04R 3/02* (2006.01)

(52) U.S. Cl. ..... 381/73.1; 381/71.1; 381/94.3; 381/104

(58) Field of Classification Search ..... 381/57, 381/71.1, 73.1, 94.1, 94.3, 104
See application file for complete search history.

(56) References Cited

U.S. PATENT DOCUMENTS

| | | | | |
|---|---|---|---|---|
| 6,145,085 | A * | 11/2000 | Tran et al. | 726/5 |
| 6,188,771 | B1 * | 2/2001 | Horrall | 381/73.1 |
| 2002/0150261 | A1 * | 10/2002 | Moeller et al. | 381/73.1 |
| 2004/0179699 | A1 * | 9/2004 | Moeller et al. | 381/73.1 |
| 2009/0116659 | A1 * | 5/2009 | Moeller et al. | 381/73.1 |

OTHER PUBLICATIONS

"What is SoundMasker"; SoundMasker-White Noise Generator/Sound Masking Software, Get a Good Nights Sleep; Copyright 2003 Vector Media; p. 1.
http://drugstore.com; HoMedics SoundSpa Acoustic Relaxation Machine, Model SS-200-3PK; p. 1-3.
http://marpac.com/sound_cond.asp; Sound Conditioners; pp. 1-6.
http://store.yahoo.com/egeneralmedical/no.html; Sound Conditions, White Noise Machines and Safety Lights; pp. 1-2.
http://www.maggiescottage.com/soundtherapy.html; Maggies Cottage—Homedics White Noise Machine & SensorySound Spa; pp. 1-2.
http://www.officebuzz.qpg.com/; The Sonet Acoustic Privacy System; pp. 1-2.
http://www.sharperimage.com; Search by Keyword: Sound Soother; pp. 1-6.

* cited by examiner

*Primary Examiner* — Vivian Chin
*Assistant Examiner* — Friedrich W Fahnert

(57) ABSTRACT

A sound masking system and method for providing sound masking in networked workstations or offices. The sound masking system comprises a communication network, a plurality of sound masking devices adapted to emit a sound masking signal, and a remote controller. One or more of the sound masking devices includes a controller, and the controller includes an interface for receiving information from the communication network and a component for controlling or adjusting output characteristics associated with the sound masking signal, such as volume. The controller includes a component responsive to a user input for setting or varying output characteristics associated with the sound masking signal.

28 Claims, 18 Drawing Sheets

SYSTEM AND METHOD FOR A SOUND MASKING SYSTEM FOR NETWORKED WORKSTATIONS OR OFFICES

FIELD OF THE INVENTION

The present invention relates to sound masking systems and more particularly to a system and method for sound masking system for workstations configured in a network.

BACKGROUND OF THE INVENTION

Sound masking systems are widely used in offices and similar workplaces where an insufficient level of background sound results in diminished speech and conversational privacy. Such environments typically suffer from a high level of noise distractions, and lower comfort levels from an acoustic perspective. Sound masking systems operate on the principle of masking, which involves generating a background sound in a given area. The background sound has the effect of limiting the ability to hear two sounds of similar sound pressure level and frequency simultaneously. By generating and distributing the background noise in the given area, the sound masking system masks or covers the propagation of other sounds in the area and thereby increases speech privacy, reduces the intrusion of unwanted noise, and improves the general acoustic comfort level in the area or space.

Sound masking systems are of two main types: centrally deployed systems and independent self-contained systems. In a centrally deployed system, a central noise generating source supplies a series of loudspeakers installed throughout the physical area or space to be covered. The independent self-contained system comprises a number of individual self-contained sound masking units, which are installed in the physical space. The sound masking units operate independently of each other. More recently, sound masking technology has been applied to workstation environments. Such systems allow an occupant to control the sound masking in an individual workstation.

Such systems suffer a number of drawbacks. First, the individually controllable sound masking units by their very nature do not allow for consistent coverage of the masking sound through the entire space encompassing the workstations. This inconsistency in distribution of the masking sound results in variations in the sound masking level, which can irritate occupants. Second, the individual controllability of the sound masking units means that a workstation occupant wishing privacy has no control over the neighboring workstations and their respective sound masking levels. As a result, individually controllable sound masking units can, at most, reduce distractions, but they cannot ensure privacy because, for example, a workstation neighbor may have the sound masking turned off or set at a low level, which does not provide for sound privacy. Third, individually controllable sound masking units do not provide overall system or facility control. For example, it is not possible to provide timer functions and other centralized control functions.

Accordingly, there remains a need for improvements in the configuration and/or control of individual sound masking units.

BRIEF SUMMARY OF THE INVENTION

The present invention provides a system and method suitable for a sound masking system for workstations, cubicles or offices configured in a network.

According to one embodiment, the present invention comprises a plurality of sound masking modules. Each of the sound masking modules is installed at a workstation and includes a local interface for controlling masking contour and/or adjusting the volume. Each of the sound masking modules includes a network interface for communicating with a controller. The controller provides a centralized control over all or a plurality of the sound masking modules.

In a first aspect, the present invention provides a sound masking system for providing sound masking in a physical space, the sound masking system comprises: a communication network spanning at least a portion of the space; a plurality of sound masking devices, each of the sound masking devices being adapted to emit a sound masking signal in a user space, and one or more of the sound masking devices including a controller for controlling one or more output characteristics associated with the sound masking signal, at least some of the output characteristics being responsive to an input from the user, and the controller includes an interface for receiving information from the communication network; a control unit including a component for affecting at least one of the output characteristics of the sound masking signal and the control unit having a network interface for transmitting output control information over the communication network; the controller of at least one of said sound masking devices includes a component responsive to the output control information for adjusting the associated output characteristic.

In another aspect, the present invention provides a method for controlling a plurality of individual sound masking speakers, wherein each of the sound masking speakers is adapted to emit a sound masking signal having one or more output characteristics controllable by a user, the method comprises the steps of: providing a communication network for coupling the sound masking speakers to a control unit; generating output characteristic control information for the sound masking speakers; providing a remote controller with a communication interface for transmitting the output characteristic control information to one or more of the sound masking speakers; providing the sound masking speakers with a component for the output characteristic control information; affecting the sound masking signal in response to the output characteristic control information.

Other aspects and features of the present invention will become apparent to more ordinarily skilled in the art upon review of the following description of specific embodiments of the invention in conjunction with the accompanying figures.

BRIEF DESCRIPTION OF THE DRAWINGS

Reference is now made to the accompanying drawings which show, by way of example, embodiments of the present invention, and in which:

FIG. 12(*b*) shows a screen-shot of a window for a controller for administering speakers in the sound masking system according to an embodiment;

FIG. 12(*c*) is a screen-shot of a window for a controller for setting optional operating parameters associated with the sound masking system according to an embodiment;

FIG. 13(*b*) is a screen-shot of a window for a speaker device for adjusting the masking volume or contour level or equalizer settings according to an embodiment;

FIG. 13(*c*) is a screen-shot of a window for a speaker device for setting sound masking level according to schedule according to an embodiment; and FIG. 13(*d*) is a screen-shot of a window for a speaker device for configuring a server connection.

DETAILED DESCRIPTION OF THE INVENTION

Figure 1:
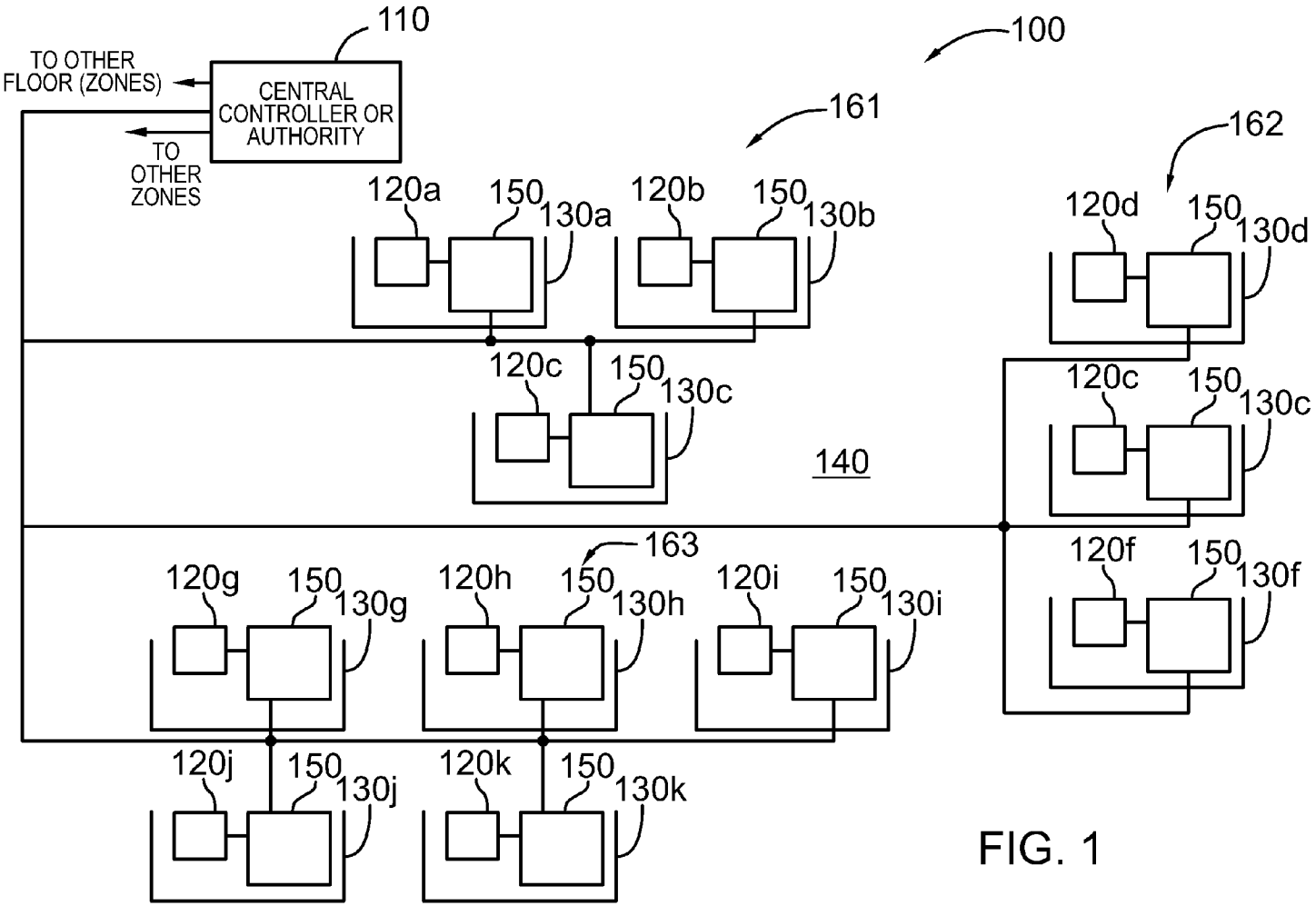
FIG. 1 shows in block diagram form a system of individually controllable sound masking modules according to one embodiment of the present invention.

Reference is made to FIG. 1, which shows in block diagram form a sound masking system 100 according to an embodiment of the present invention. The sound masking system 100 comprises a control unit 110 (e.g. central or remote controller) and a number of sound masking modules 120, indicated individually as 120*a*, 120*b*, 120*c*, 120*d*, . . . 120*k*. The sound masking modules 120 are typically installed in a personal or user space or work area, for example, a workstation 130 or cubicle, office or other type of partitioned space, indicated individually as 130*a*, 130*b*, 130*c*, 130*d*, . . . 130*k*, in an office or physical space 140. In the context of the present description, each of the sound masking modules 120 comprises a device, which is installed in, or coupled to, a computer 150 in the user workspace, e.g. the workstation 140. In one embodiment, the control unit 110 comprises a computer or server which is coupled to the workstation computers 150 through a network connection for example, a LAN (Local Area Network), a WAN (Wide Area Network) or the Internet or a network, for example, a VPN (Virtual Private Network) running on the Internet. As will be described in more detail below, according to one embodiment of the present invention, the sound masking modules 120 are individually controllable by a user in workstation 130 via the computer 150, and the sound masking modules 120 to a centralized control function by the control unit 110 on the server.

According to another embodiment, the sound masking modules 120 (and the workstation 130 and/or associated computer 120) are arranged in or grouped in zones. For the embodiment depicted in FIG. 1, there are three zones indicated by references 161, 162 and 163 for the space 140. The first zone 161 comprises the workstations and sound masking modules 130*a* and 120*a*, 130*b* and 120*b*, 130*c* and 120*c*, respectively. The second zone 162 comprises the workstations and sound masking modules 130*d* and 120*d*, 130*e* and 120*e*, 130*f* and 120*f*, respectively. The third zone 163 comprises the workstations and sound masking modules 130*g* and 120*g*, 130*h* and 120*h*, 130*i* and 120*i*, 130*j* and 120*j*, 130*k* and 120*k*, respectively. The operation and administration of "zones" is described in more detail below.

Figure 2:
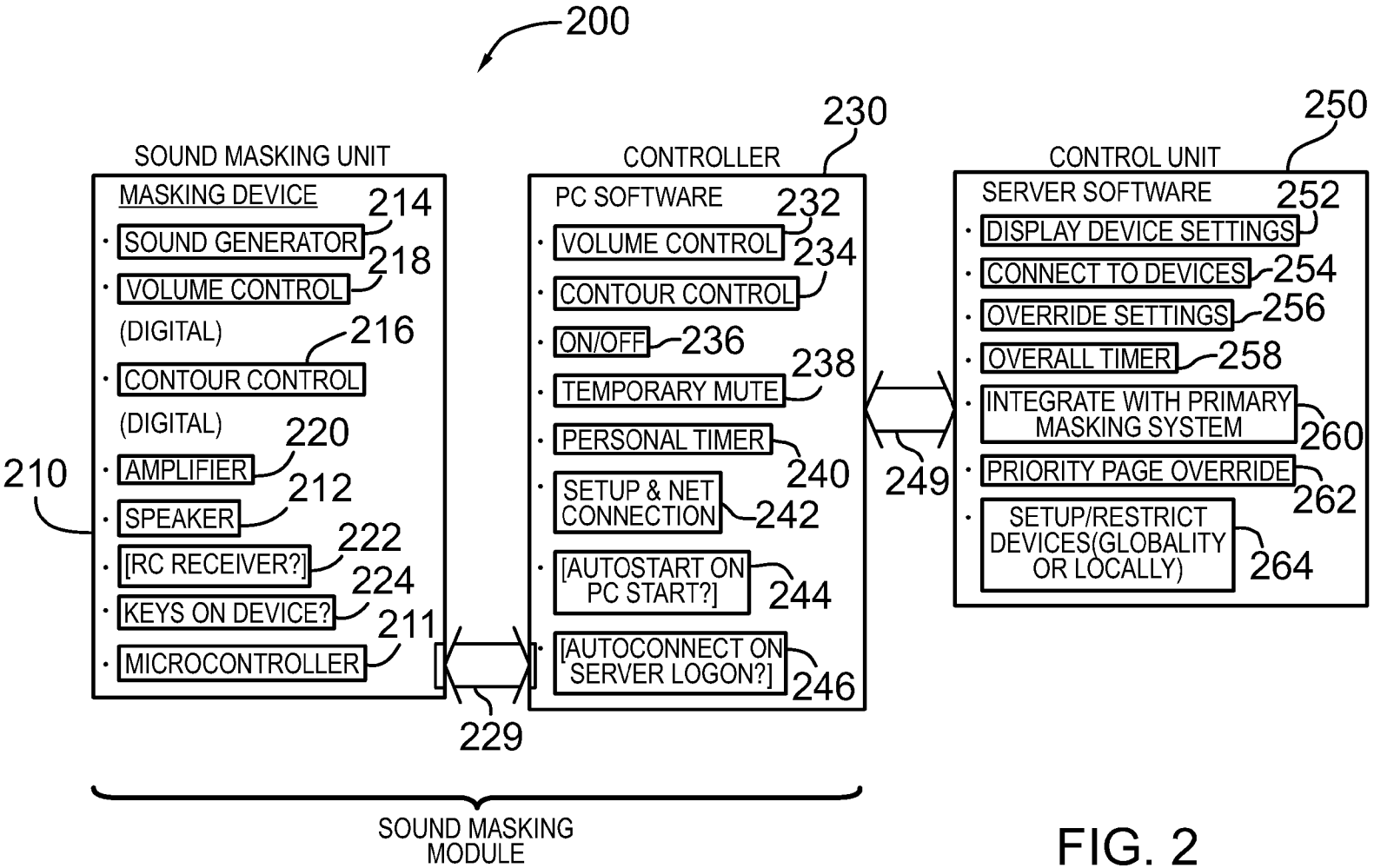
FIG. 2 shows an individually controllable sound masking module according to one embodiment.

Reference is next made to FIG. 2, which shows one embodiment of a sound masking module according to the present invention and indicated by reference 200. The sound masking module 200 comprises a sound masking unit 210 and a controller 230. The controller 230 controls functions associated with the sound masking unit 210 as will be described in more detail below. In addition, the controller 230 provides an interface 249 to the control unit, which is indicated by reference 250 in FIG. 2. The interface 249 provides a communication link, i.e. network connection, with the control unit 250, which allows for centralized control or networked control functions as will be described in more detail below.

Referring to FIG. 2, the sound masking unit 210 comprises a microcontroller 211, a speaker 212, a sound generator 214, a contour control stage 216 and a volume control stage 218. The sound masking unit 210 also includes an amplifier 220. In another embodiment, the amplifier (not shown) is integrated with the volume control stage 218. The microcontroller 211, for example, a microprocessor operating under stored program control (i.e. firmware) controls the operation of the sound masking unit 210, i.e. the sound generator 214 to generate a sound masking signal which is amplified by the amplifier 218 and outputted to the speaker 212. The contour control stage 216 and the volume control stage 218 provide additional control over the contour and volume of the sound masking signal, respectively, for example, in response to user input and/or input from the control unit 250, as will be described in more detail below.

As shown in FIG. 2, the sound masking unit 210 interfaces to the controller 230 through a communication interface indicated by reference 229. The controller 230 uses the communication interface 229 for control commands and/or status requests to control and/or monitor the operation of the sound masking unit 210. In one embodiment, the controller 230 is implemented in the form of a computer program or software module, which, for example, runs as an application on the workstation computer 150. In one embodiment, the sound masking unit 210 is implemented in the form of a circuit board, which is installed internally in the computer 150 and the speaker 212 comprises a speaker external to the computer 150 or in the alternative an internal speaker on the computer 150. In another embodiment, the sound masking unit 210 is implemented in the form of an external peripheral device, which connects to a port on the computer 150, for example, a USB port 229, or via a wireless communication port, indicated generally by reference 222. For such an implementation, the sound masking unit 210 may include a key pad 224 having one or more function keys, for example, for controlling the contour and volume.

Referring to FIG. 2, the controller 230 is implemented in software according to this embodiment and comprises a plurality of code components, i.e. functions or routines. The code components or functions for the controller 230 comprise a volume control component 232, a contour control component 234, an on/off component 236, a mute component 238, a user timer component 240 and a setup component 242. The controller 230 may also include an auto-start code component 244 and/or an auto-connect component 246. The operation of the sound masking device 210 and the controller 230 is described in more detail with reference to the flowcharts in FIGS. 4-11 and the screen-shots of FIGS. 12-13.

As shown in FIG. 2, the control unit comprises a computer program or software module, which runs, for example, as an application on the server computer 110 (FIG. 1), and is indicated generally by reference 250. The control unit 250 provides a control or network function for one or more of the sound masking modules 120 installed in the workstations 140. For the software implementation, the control unit 250 comprises a plurality of code components (i.e. functions) including a display device settings component 252, a connect to devices component 254, an override settings component 256, an overall timer component 258, a sound masking integration component 260, a priority page override component 262 and a setup devices component 264. The operation and functionality associated with the control unit 250 is described in more detail below with reference to the drawings. As will be described in more detail below, one of the functions of the control unit 250 (i.e. the central controller 110) is to limit or control the volume of the sound masking device(s), for example, to restrict the specific or allowed volume range.

Figure 3:
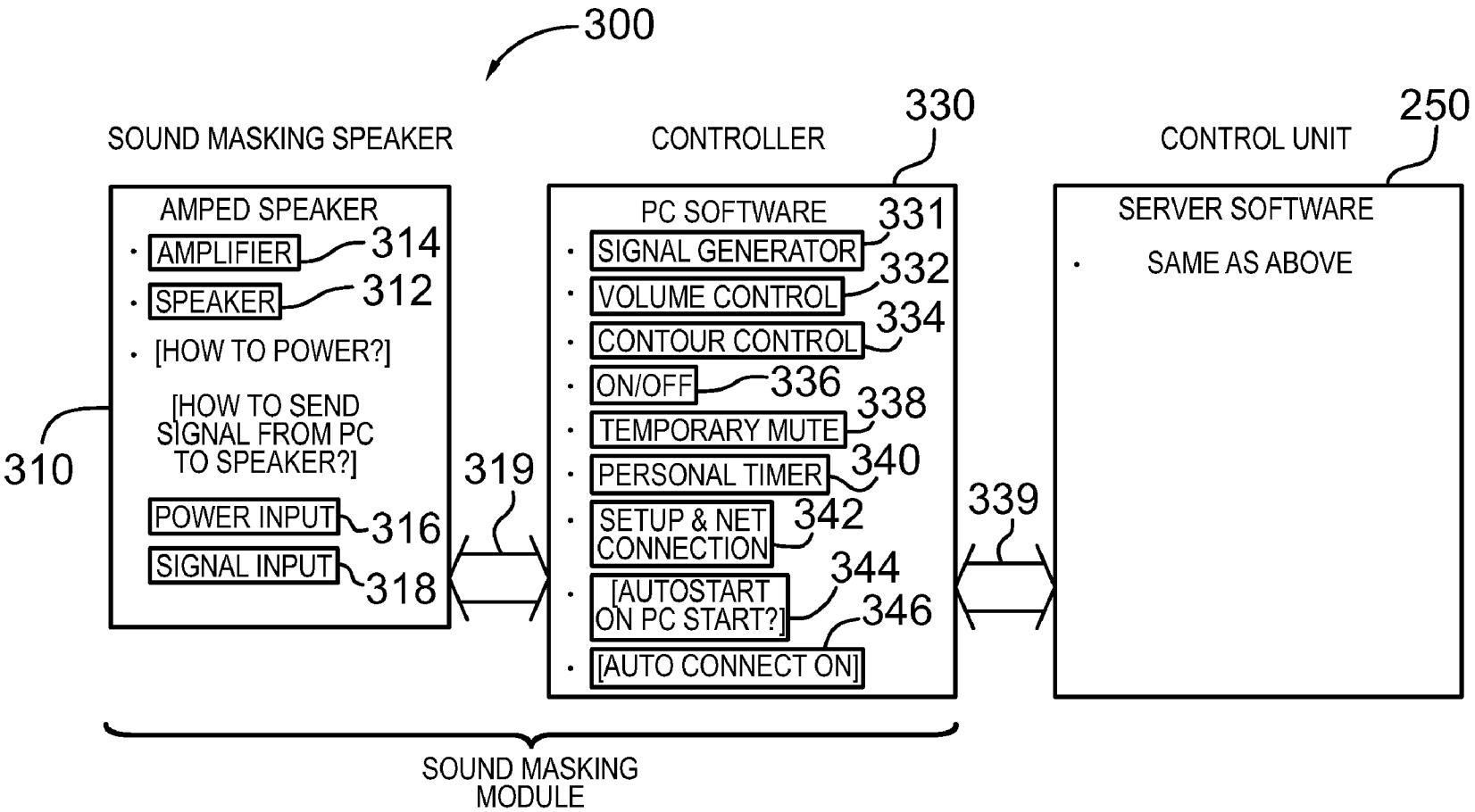
FIG. 3 shows an individually controllable sound masking module according to another embodiment.

Reference is next made to FIG. 3, which shows a sound masking module according to another embodiment of the present invention and indicated generally by reference 300. The sound masking module 300 according to this embodiment comprises a sound masking speaker 310 and a controller 330. The controller 330 controls functions associated with the sound masking speaker 310 as will be described in more detail below. In addition, the controller 330 provides an interface 339 to the control unit, which is also indicated by reference 250 in FIG. 3. The interface 339 provides a communication link, i.e. network connection, with the control unit 250, which allows for centralized control or networked control functions as will also be described in more detail below.

Referring to FIG. 3, the sound masking speaker 310 comprises a speaker 312 and an amplifier 314. The sound masking speaker 310 also includes a power input port 316 and a signal input port 318. According to this embodiment, the controller 330 supplies a sound masking signal to the sound masking speaker 310, i.e. via the signal input port 318. The controller 330 may also provide power to the sound masking speaker 310, i.e. via the power input port 316. According to one embodiment, the sound masking speaker 310 receives power and sound masking signals over an interface 319, which may be implemented using a USB interface, or other type of power and signal interface.

In one embodiment, for example as described above with reference to FIG. 2, the controller 330 is implemented in the form of a computer program or software module, which runs as an application on the workstation computer 150. As shown in FIG. 3, the controller 330 is implemented in software according to this embodiment and comprises a plurality of code components, i.e. functions or routines. The code components or functions for the controller 330 comprise a sound masking signal generator 331, a volume control component 332, a contour control component 334, an on/off component 336, a mute component 338, a user timer component 340 and a setup component 342. In another embodiment, the sound masking signal generator is implemented in a circuit board (not shown) in the controller 330. The controller 330 may also include an auto-start code component 344 and/or an auto-connect component 346. The operation of the sound masking speaker 310 and the controller 330 is described in more detail below.

The control unit 250 for the sound masking module 300 of FIG. 3 is implemented in a similar fashion as described above for FIG. 2.

Figure 4:
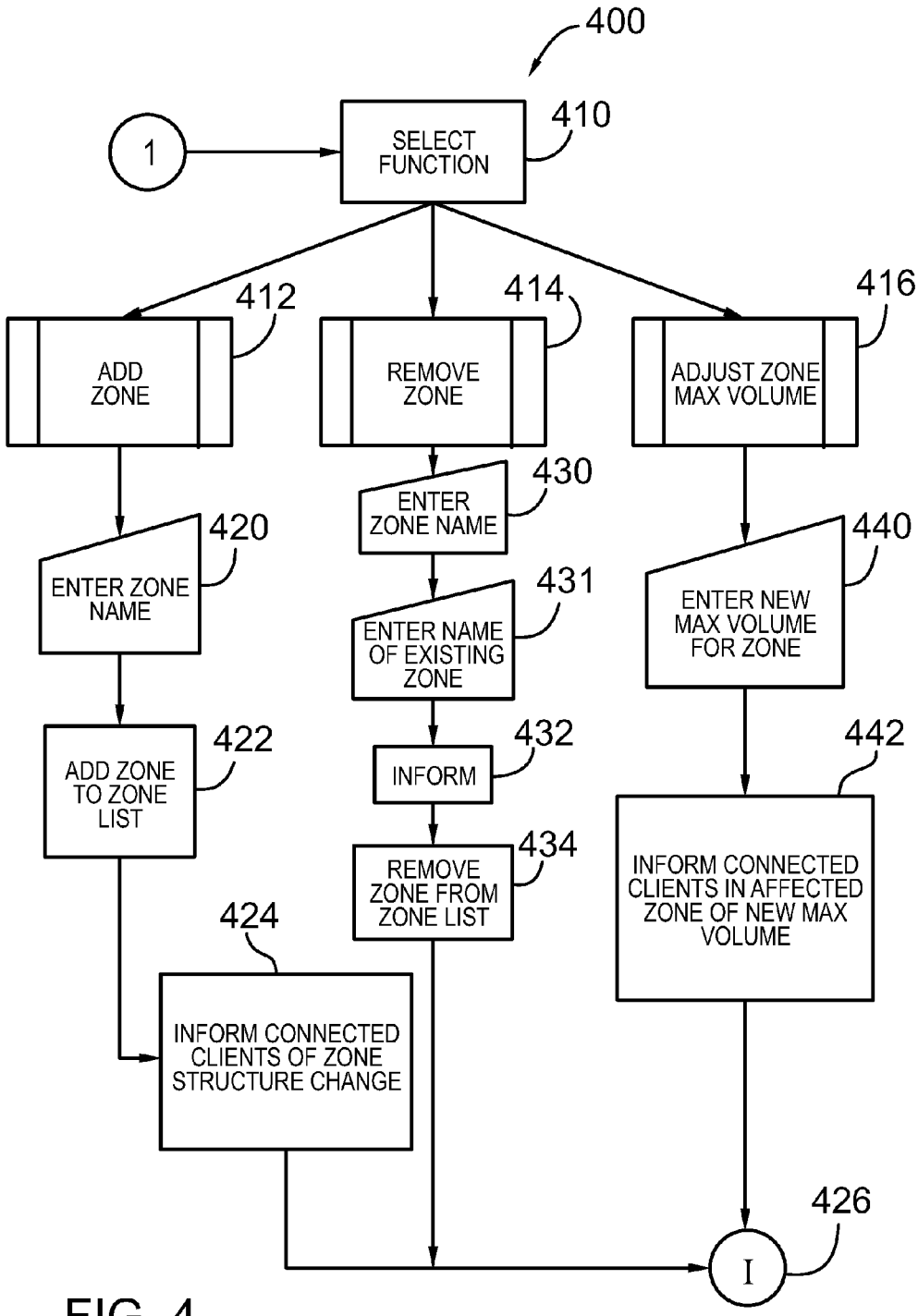
FIG. 4 shows in flowchart form a process for a controller for controlling a plurality of speakers or groups of speakers according to one embodiment.

Reference is next made to FIG. 4, which shows in flowchart form a process for controlling or administering zones according to an embodiment of the present invention. The process for controlling zones (for example, the zones 161, 162, 163 in FIG. 1) is indicated generally by reference 400. The zone administration process 400 provides a capability for adding or removing zones from a centralized sound masking system using the central controller or authority 110 (FIG. 1). The zone administration process 400 is typically configured as a restricted access function on the central controller 110, for example, a password protected function to be accessed by an administrator. As shown in FIG. 4, the zone administration process 400 includes a select function denoted by reference 410. The select function 410 allows the administrator to choose an add zone function 412, a remove zone function 414, or an adjust zone volume function 416. Under the add zone function 412, the administrator enters a zone name in step 420 and the zone administration process 400 includes a function 422 to add the entered zone name to a zone list. The zone administration process 400 maintains a zone list. The zone administration process 400 includes inform function(s) which inform connected clients of the change in the zone structure. In the context of the present description, the term "client" refers to a sound masking module 120 (FIG. 1) coupled or installed to a computer 150 (FIG. 1), and for example, situated in a workstation or cubicle 130 (FIG. 1) in an office space 140 (FIG. 1). The add zone function 412 includes an inform function 424 to inform the client(s) of the change in the zone structure. Under the remove zone function 414, the administrator enters the name of a zone to be removed in step 430 and in step 431 enters the name of an existing zone to replace the one being removed. The zone administration process 400 uses an inform function 432 to inform the connected clients of the change in the zone structure, e.g. the removal of the zone. The zone administration process 400 includes a function 434 to remove the entered zone name from the zone list. The adjust zone volume function 416 provides the administrator with the capability to adjust or set a volume level or maximum volume level for anyone of the zones. The administrator enters a volume setting (e.g. a maximum volume level) for a zone in step 440. The zone administration process 400 includes another inform function 442 to inform the clients in the effected zone of the change in the volume setting. In one embodiment, the inform function 442 includes a function or code component which downloads a command to set the volume level in the sound masking module(s) 120 in the relevant zone(s). For example, with reference to FIG. 2, the control unit 250 utilizes the inform function 442 to send a volume message or command which is received and processed by the volume control module 332 in the controller 230, for example, to limit the volume. The controller 230 then optionally sends an appropriate volume control command or signal to the volume control module(s) 218 in the effected sound masking unit(s) 210, i.e. if the volume exceeds the newly imposed limit. Upon completion of any of the functions, i.e. add zone 412, remove zone 414 or adjust zone volume 416, execution of the zone administration function terminates or returns to a calling function or program, as indicated generally by step 426. In this way, an overall sound masking level can be created or managed for the physical space, which includes a number of sound masking modules and/or zones.

Figure 5:
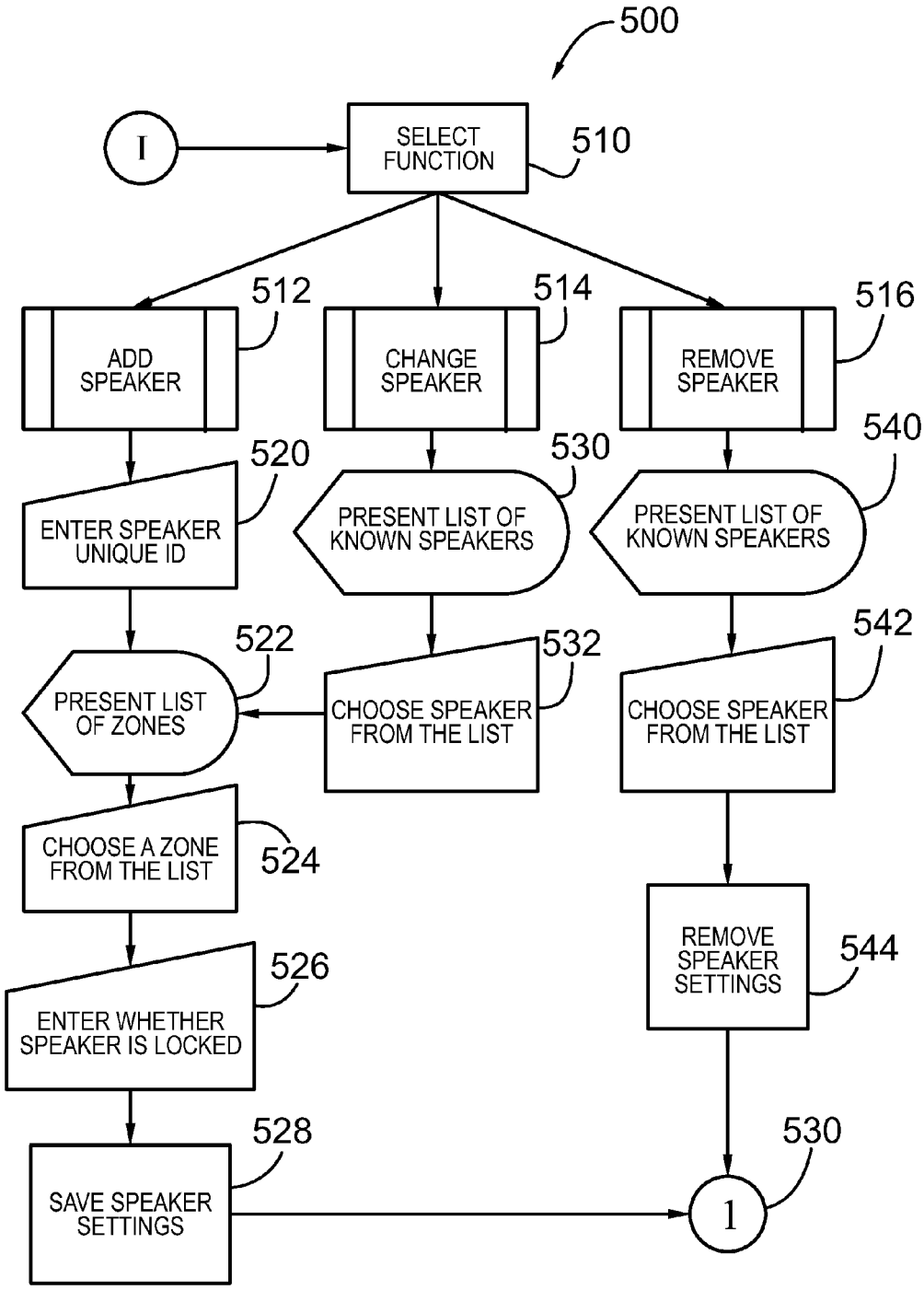
FIG. 5 shows in flowchart form a process for a controller for administering speakers in the sound masking system of FIG. 1 according to one embodiment.

Reference is next made to FIG. 5, which shows in flowchart form a process for administering speakers in the sound masking system 100 (FIG. 1) according to an embodiment of the present invention. In the context of the present description, the term "client" refers to a sound masking module 120 (FIG. 1) coupled or installed to a computer 150 (FIG. 1), and for example, situated in a workstation or cubicle 130 (FIG. 1) in an office space 140 (FIG. 1). The process for administering speakers is indicated generally by reference 500 in FIG. 5. The speakers 212 (FIG. 2) or 312 (FIG. 3) are either known or not known by the central controller or authority 110 (FIG. 1). According to this embodiment, the speakers 212 or 312 that are known by the central controller 110 are identified with the following information or data: (i) a (unique) speaker identifier or ID; (ii) a zone affiliation; and/or (iii) a locked status. The central controller 110 obtains the unique speaker ID for the speaker 212 (or 312) from the associated sound masking module (i.e. the "client") 120 (FIG. 1). As shown in FIG. 5, the speaker administration process 500 includes a select function denoted by reference 510. The select function 510 allows the administrator to choose an add speaker function 512, a change speaker function 514, or a remove speaker function 516. The central controller 110 controls the zone affiliation and the locked status associated with the speaker 212 or 312. According to another aspect, if the speaker 212 or 312 has a locked status, then the administrator, i.e. the central controller 110, controls the zone affiliation for the speaker 212 or 312. If, on the other hand, the speaker 212 or 312 does not have a locked status, then the client, i.e. the user of the sound masking module 120, may assign the speaker 212 or 312 to any existing zone, for example, 161, 162 or 163 in FIG. 1.

As shown in FIG. 5, under the add speaker function 512, the administrator (i.e. the central controller or authority) enters a unique speaker ID in step 520. According to one embodiment, the administrator enters the speaker ID's manually, and they are stored in memory, for example, as a list or in the form of table. In another embodiment, a speaker (i.e. sound masking module 200 or 300) requests a connection, and if the connection is permitted, the central controller 110 adds the speaker ID. The speaker administration process 500 includes a function 522, which presents a list of zones. Next in step 524, the administrator chooses a zone from the presented (e.g. displayed) list. In step 526, the administrator decides whether to lock the speaker in question. As described above, if a speaker is locked, then the client is not permitted to control the zone affiliation or assignment. Next in step 528, the settings entered by the administrator for the speaker are saved, i.e. written to memory, and the add speaker function 512 terminates or returns to a calling function or program, as indicated generally by step 530.

The change speaker function 514 allows the administrator to select a speaker and change the zone associated with the speaker and/or the locked status for the speaker. As shown in FIG. 5, the first operation in the change speaker function 514 involves presenting a list of known speakers in step 530. The administrator or central authority then uses the list to choose a speaker of interest from the list in step 532. Next, processing moves to step 522, and a list of zones is presented to the administrator as described above. The administrator then has the option of choosing a zone in step 524 for the speaker selected in step 532. Next, or in the alternative, the administrator can set the selected speaker to a locked state in step 526. In step 528, the settings entered by the administrator for the speaker are saved, for example, written to memory, and control returns to a calling function or program, as indicated generally by step 530.

The remove speaker function 516 allows the user to remove a speaker (and its settings) from the sound masking system. As shown, the first operation in the remove speaker function 516 involves presenting a list of known speakers in step 540. The administrator uses the list to choose a speaker to be removed in step 542. The system, i.e. the central controller 110, then removes the setting associated with the speaker in step or block 544, after which, control returns to the calling function or program in step 530.

Figure 6:
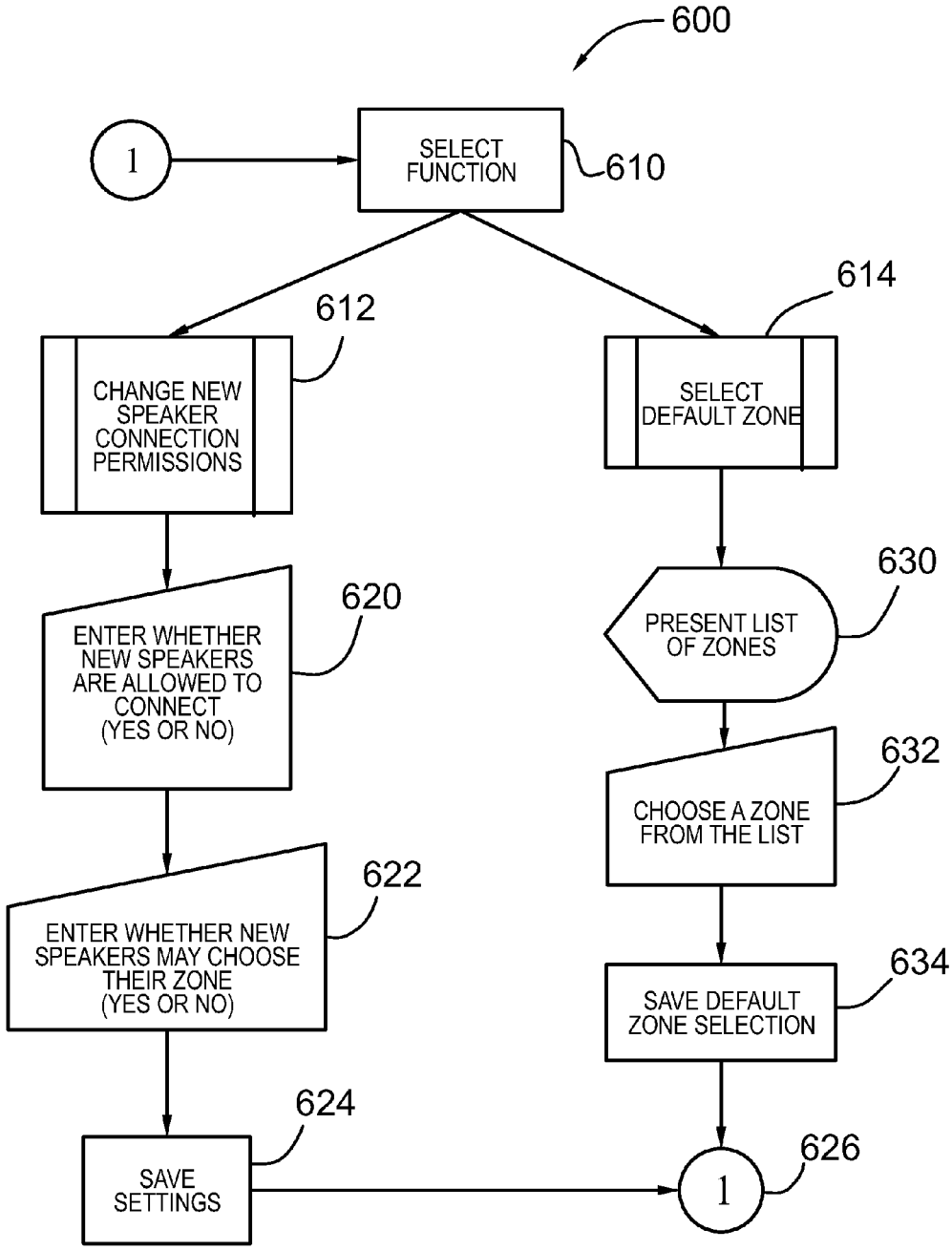
FIG. 6 shows in flowchart form a process for a controller for administering speaker connections according to one embodiment.

Reference is made to FIG. 6, which shows in flowchart form a speaker connection administration process indicated generally by reference 600. According to the speaker connection administration process 600, speakers (i.e. sound masking devices) that are known to the central controller or authority 110 (FIG. 1) are either allowed to connect to the system and operate within the limits configured for an assigned zone, or the speakers are not permitted to connect. In a further aspect, when a new speaker connects, the speaker can be allowed to specify a zone affiliation. If not allowed, or if the user specifies an invalid zone, then the new speaker is assigned to a default zone.

The speaker connection administration process 600 runs on the central controller 110 and typically accessed by the administrator. As shown in FIG. 6, the speaker connection administration process 600 includes a select function 610 for choosing a change new speaker connection permission function 612 or a select default zone function 614. The first step in the change new speaker connection permission function 612 comprises the administrator setting whether previously unknown speakers are allowed to connect to the sound masking system 100 (FIG. 1) as indicated by block 620. The next step in block 622 comprises the administrator setting whether a new speaker is allowed to choose their own zone. The last step in the new speaker connection administration process 600 involves saving in memory the settings entered by the administrator, as indicated by block 624, and returning control to the calling program or function in block 626.

The first step or operation in the select default zone function 614 comprises the central controller presenting a list of zones configured in the sound masking system, as indicated by block 630. The administrator then selects a zone from list to be the default zone, as indicated by block 632. The selected zone is then saved in memory as the default zone in block 634, and control returns to the calling program or function in block 626.

Figure 7:
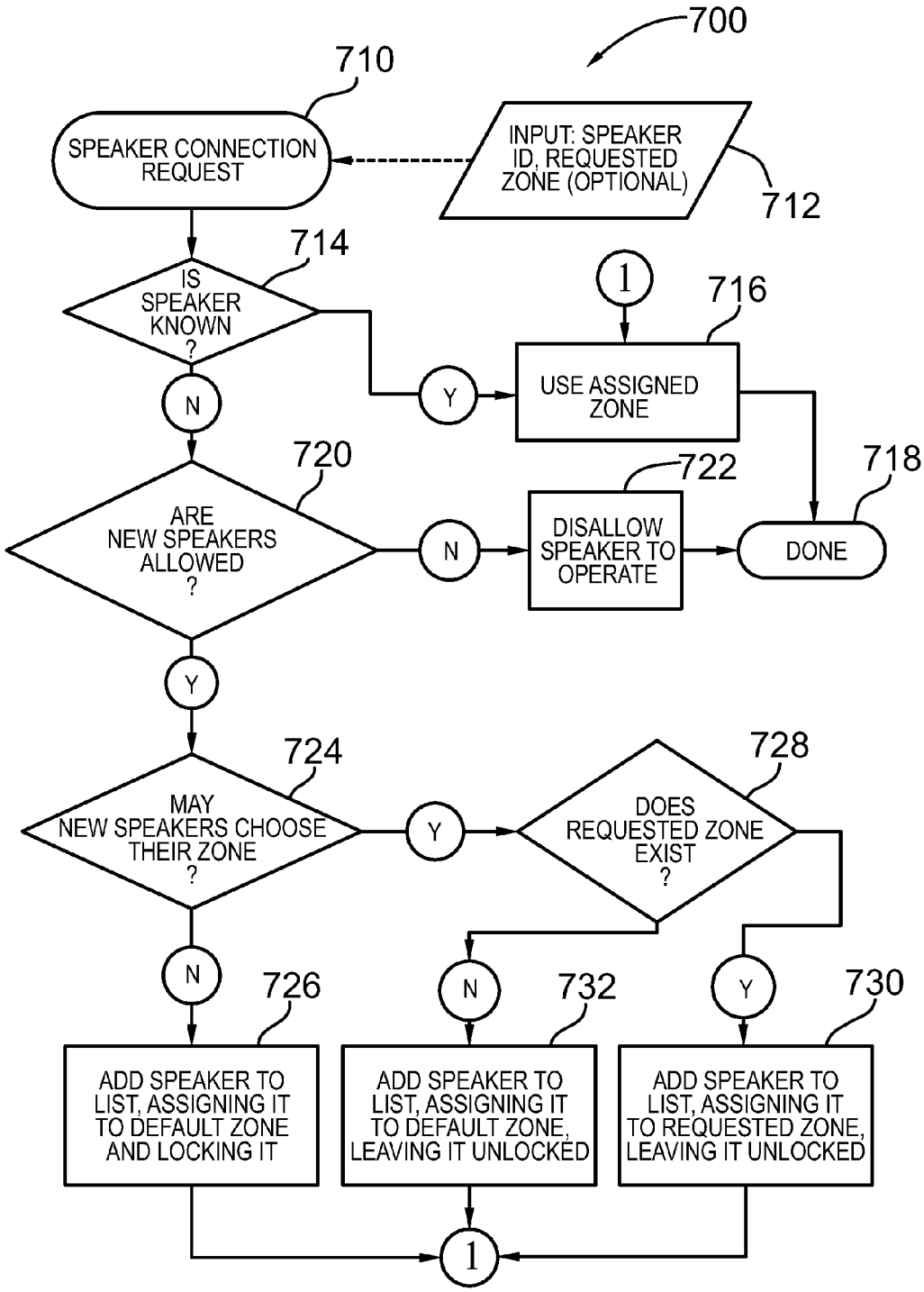
FIG. 7 shows in flowchart form a process for a controller for connecting a speaker according to one embodiment.

Reference is next made to FIG. 7, which shows in flowchart form a process for administering or controlling the connection of speakers 700 in the sound masking system 100 (FIG. 1) according to an embodiment of the present invention. Before a local speaker, e.g. speaker 212 (FIG. 2) or speaker 312 (FIG. 3), can operate in the sound masking system 100, the computer 150 associated with the speaker must connect to the central controller 110 (FIG. 1). This process includes the controller program or code function, e.g. 230 (FIG. 2) or 330 (FIG. 3) running on the computer 150, obtaining an assigned zone from the central controller 110 (i.e. the central authority). As described above, the zone may be selected by the computer 150 (i.e. the user) or assigned by the central controller 110 (i.e. the central authority), e.g. if the sound masking device is locked, for example as described above.

As shown in FIG. 7, the first step in the speaker connection process 700 involves generating a speaker connection request in block 710. The speaker connection request may be generated by a user (i.e. the client) or automatically by the speaker controller 230 (FIG. 2) or 330 (FIG. 3). For example, a user can generate a connection request using a graphical user interface (GUI) on the computer 150 (FIG. 1) which is connected or associated with the sound masking module 120 (FIG. 1). On the speaker controller side, a speaker connection request can be initiated in response to a new speaker 312 or sound masking module 120 being connected (e.g. a "plug and play" installation), or as part of a background or maintenance polling routine which checks for any sound masking module(s) 120 or speakers to the speaker controller 150. In response to a physical connection of a speaker, the speaker controller 150 makes a request for the speaker ID and optionally a user specified zone, as indicated in step 712. The request is then sent by the speaker controller 150 to the central controller 110 (FIG. 1). After receipt of the speaker ID for the new speaker, the central controller 110 (e.g. a function in software running on the central controller 110) determines if the speaker is known, for example, by comparing the speaker ID to a list of known or previously identified speaker ID's stored in memory, as indicated in decision block 714. If the speaker is known, then the central controller 110 uses the assigned zone associated with the speaker, as indicated in step 716, and the process terminates or returns control to a calling function, as indicated in step 718.

Referring to FIG. 7, if the speaker 212 (FIG. 2) or 312 (FIG. 3) is not known as determined in decision block 714, then the central controller 110 (i.e. a computer program or code module executed by the controller) determines in decision block 720 if new, i.e. previously unknown, speakers can be added to the sound masking system 100. If the speaker cannot be added, then the central controller 110 blocks connection of the speaker in block 722 and the central controller 110 may include a function which notifies the user, for example, by displaying a message on the display monitor of the associated computer 150 (FIG. 1). The process terminates or returns control to a calling function, as indicated in step 718.

If a connection of a new (i.e. previously unknown) speaker is allowed (i.e. as determined in decision block 720), then the central controller 110 ascertains in decision block 724 whether the user or client is allowed to choose a zone for the new speaker connection. If the client is not allowed to choose a zone for the new speaker, then the central controller 110 adds the speaker to the list of known or recognized speakers and assigns the speaker to the default zone as indicated by block 726. The speaker is locked, i.e. prevented from changing its zone. If the user is allowed to select a zone for the new speaker (as determined in decision block 724), then the central controller 110 checks if the zone requested by the user exists in the sound masking system 100, as indicated by decision block 728. If the zone requested by the user does exist, the central controller 110 adds the speaker to the list of known or recognized speakers and assigns the speaker to the requested zone as indicated by block 730. The speaker is set to unlocked, which allows the user to change the zone at a later time. On the other hand, if the zone requested by the user does not exist, then the central controller 110 assigns the speaker to the default zone. In this case, the central controller 110 leaves the speaker unlocked, giving the user or client the capability to select another zone, i.e. a zone that exists in the sound masking system 100. As shown in FIG. 7, after the zone (i.e. default or requested) is assigned to the speaker in step 726, 730 or 732, the central processor 110 utilizes the assigned zone according to step 716 and the process terminates or control returns to a calling function or program in step 718.

Figure 8:
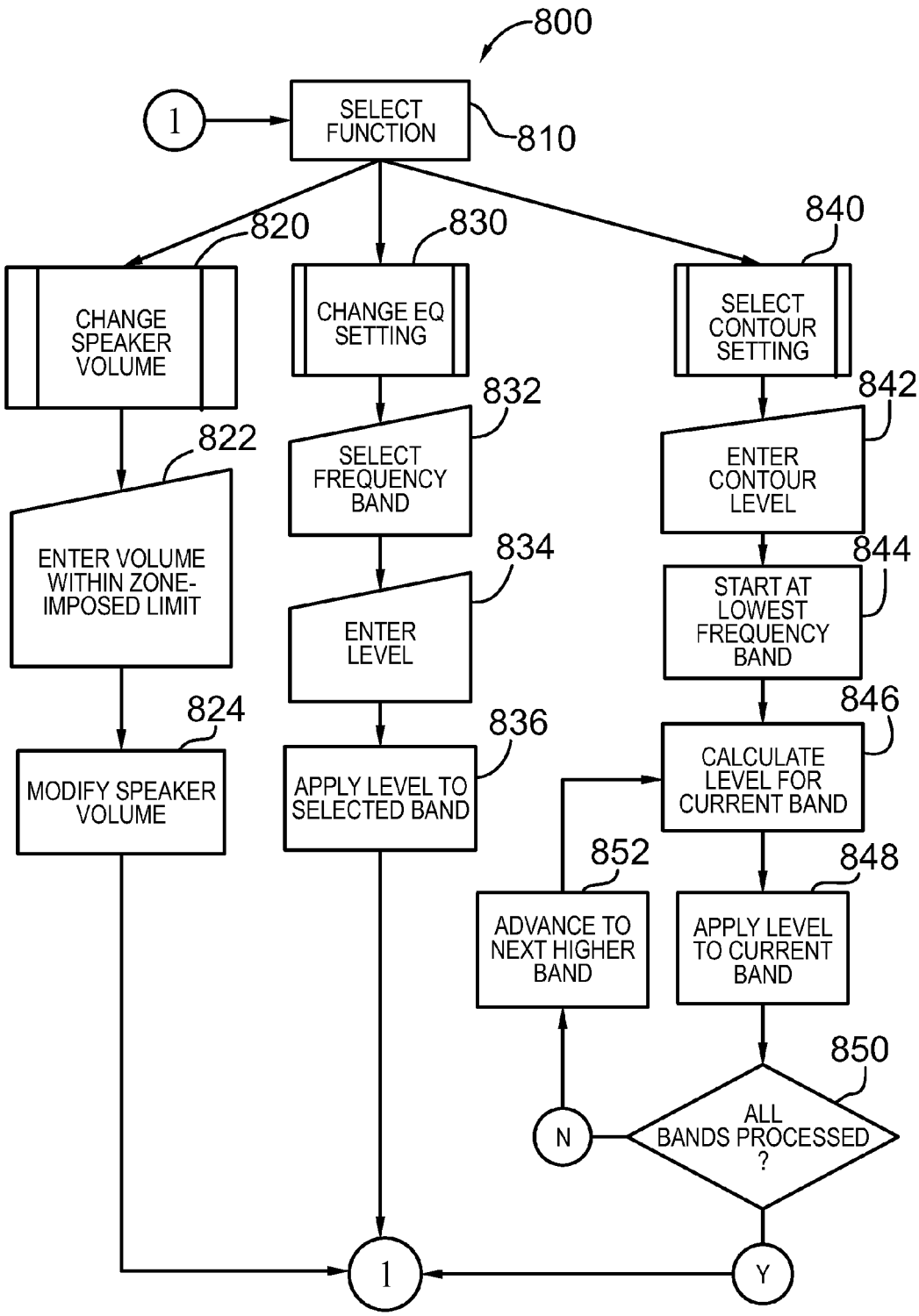
FIG. 8 shows in flowchart form a process for a speaker device for changing operating parameters of a speaker according to one embodiment.

Reference is next made to FIG. 8, which shows in flowchart form a process indicated generally by reference 800 for providing a user or client with the capability to adjust volume and/or equalizer settings for the speaker 212 (FIG. 2) or 313 (FIG. 3) for the sound masking module 120 (FIG. 1) configured in the user's workstation 130 (FIG. 1). As shown, the process for user (i.e. personal) speaker control 800 comprises a select function 810 for selecting a change speaker volume function 820, a change equalizer setting function 830, and a select contour setting function 840. According to this aspect of the invention, while the user may adjust or change the volume settings for the speaker 212 (FIG. 2) or 312 (FIG. 3), the volume is restricted to the limit(s) associated with the zone assigned to the speaker, as selected by the user (i.e. the client) or by the central controller, for example, as described above. According to another aspect, the user may adjust equalizer settings for the contour control module 216 and/or 234 (FIG. 2), or the contour control module 334 (FIG. 3) for the sound masking speaker 310 embodiment in FIG. 3. According to another aspect or function, the equalizer settings may be adjusted en masse using the contour level function, or on an individual band-by-band basis (for example, according to the screen of FIG. 13(*b*) described below).

According to the change speaker volume function 820, a user enters a volume setting for the speaker, as indicated in step 822. If the volume setting is within the limit for the zone associated with the speaker, then the central controller 110 allows the volume setting to be applied to the speaker. The volume setting is applied to the volume control module 218 and the amplifier 220 through the controller 230 (i.e. the volume control module 232), or for the embodiment of FIG. 3, the volume setting is applied to the amplifier 314 coupled to the speaker 312 through the controller 330 (i.e. the volume control module 332).

The change equalizer setting function 830 allows a user to adjust the equalizer settings on an individual band-by-band basis. As shown, the user selects a frequency band in step 832 and enters a corresponding level for the selected band in step 834. For the embodiment of FIG. 2, the user entered level is applied for the selected frequency band by the controller 230 (i.e. the contour control module 234) and the contour control module 216 in the sound masking unit 210. For the sound masking speaker 310 of FIG. 3, the user entered level is applied for the selected band by the controller 330 (i.e. the contour control module 334) to the speaker 312.

The select contour setting function 840 allows a user to adjust the contour level using pre-selected equalizer settings. As shown in FIG. 8, the user enters a contour level, as indicated by step 842. The controller 230 (i.e. the contour control module 234) starts at the lowest frequency band (block 844) and calculates the band level for the current frequency band (block 846). The contour control module 234 then applies the band level (i.e. as determined in block 846) to the current frequency band, as indicated by block 848. The controller 230 then checks if all the frequency bands have been processed, as indicated by decision block 850. If all the bands have been processed, then control returns to the select function step 810 or to a calling program or function. If all the bands have not been processed, then the contour control module 234 advances the frequency band to the next highest band in block 852 and the process for determining and applying the level is repeated in blocks 846 and 848.

Figure 9:
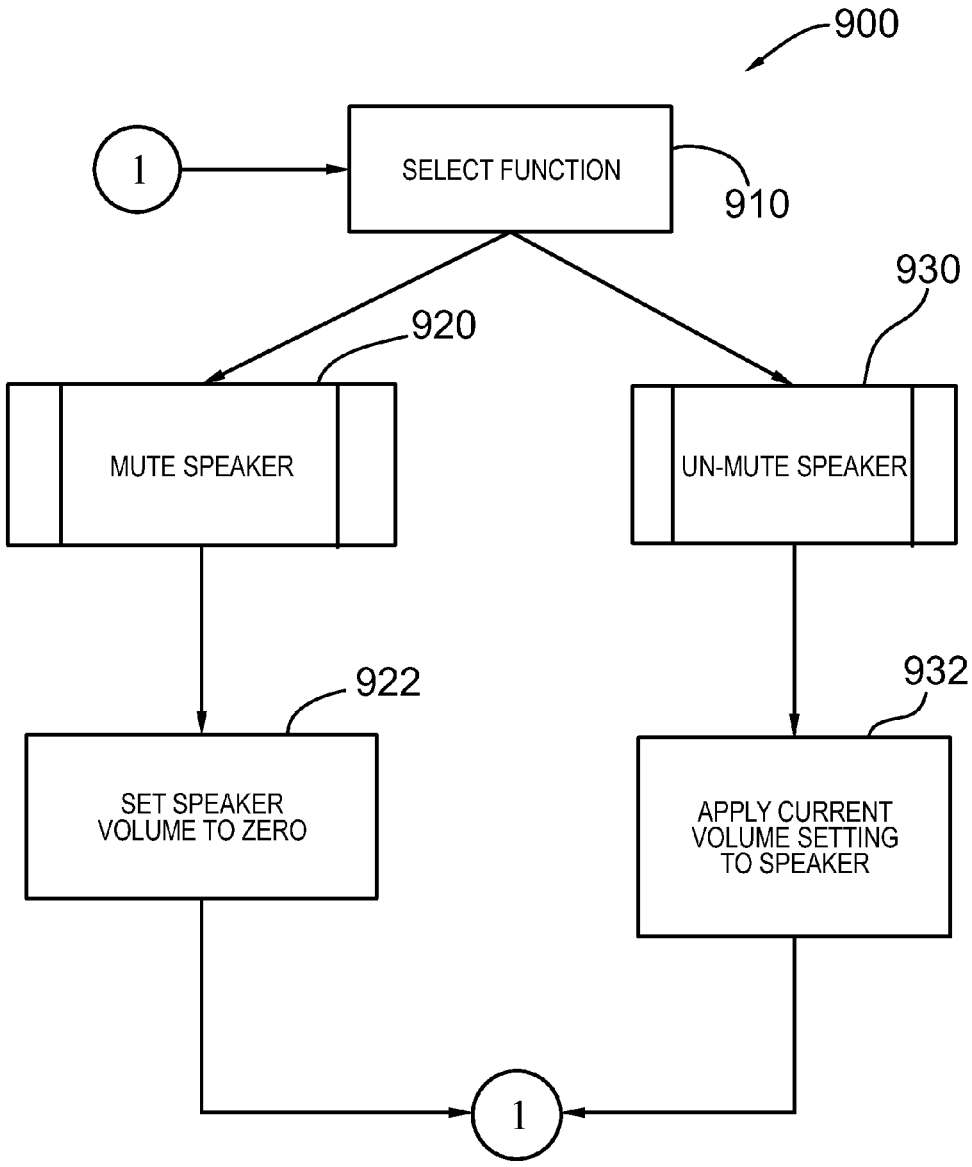
FIG. 9 shows in flowchart form a process for a speaker device for muting a speaker in the sound masking system.

Reference is next made to FIG. 9, which shows in flowchart form a process or function for speaker volume control by a user. The speaker volume control function is indicated generally by reference 900. The speaker volume control function 900 comprises a select function 910 for selecting between a mute speaker function 920 and an un-mute speaker function 930. The mute speaker function 920 comprises a set speaker volume to zero, i.e. "mute", operation indicated by block 922. For the embodiment of FIG. 2, the temporary mute function module 238 (FIG. 2) in the controller 230 (FIG. 2) sets the volume of the speaker 212 (FIG. 2) to zero, in response to the user selecting the mute function. The un-mute speaker function 930 comprises a function 932, which applies the current volume setting to the speaker in the sound masking module 120 (FIG. 1). The current volume setting may have changed if a schedule is in effect. It is also possible that the user can change the volume control while the speaker is muted.

Figure 10:
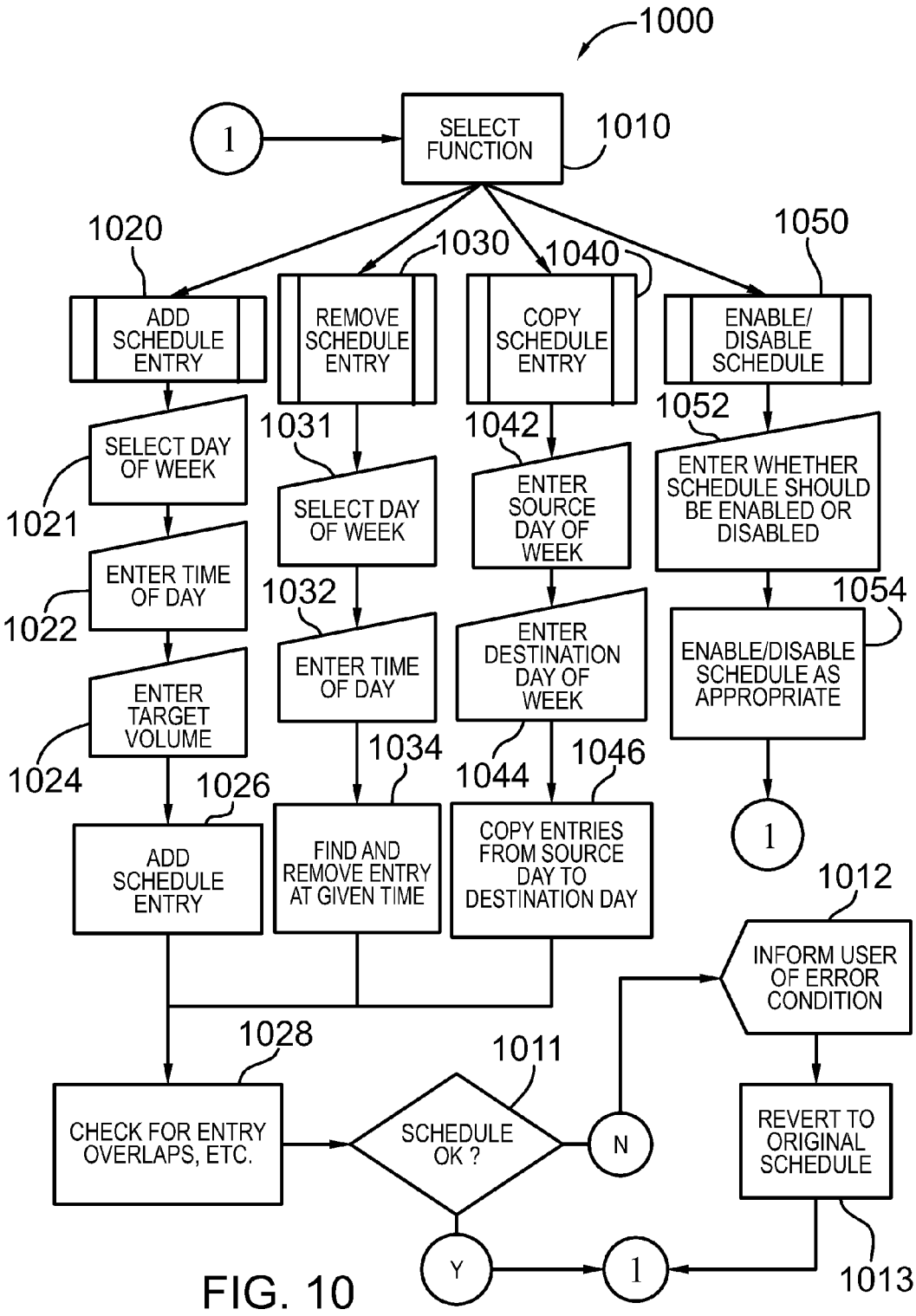
FIG. 10 shows in flowchart form a process for a speaker device for setting a volume control schedule for a speaker in the sound masking system.

Reference is next made to FIG. 10, which shows a process or function indicated generally by reference 1000 for allowing a user to control the volume of the sound masking speaker according to a defined schedule. This function allows the user to set a speaker volume schedule, enable/disable the schedule, edit the schedule for each day of the week, and copy the schedule from one day to another day. As will be described, each schedule entry includes a start time, a target volume, and a rate of volume change.

As shown in FIG. 10, the speaker volume control schedule function 1000 comprises a select function 1010 for selecting between an add schedule entry function 1020, a remove schedule entry function 1030, a copy schedule entry function 1040 and an enable/disable schedule function 1050. The add schedule entry function 1040 allows a user to set a schedule (i.e. a personal schedule) for varying the volume of the sound masking signal for the sound masking module 120 (FIG. 1). The first operation involves the user selecting a day of the week (block 1021), followed by the user entering the time of day (block 1022), and then entering a target volume and rate (block 1024). The controller 230 (FIG. 2), i.e. a software function or process, generates a schedule entry based on the user entered parameters, as indicated by block 1026. Next in block 1028, the schedule entry is verified, e.g. a check is made for schedule entry overlaps. If verification does not pass in decision block 1011, e.g. there is a schedule overlap, then the controller 230 informs the user of the error in block 1012 and then reverts to the original or previous schedule, as indicated by block 1013. If the verification of the schedule entry passes (in decision block 1011), then control returns to the calling program or function.

The enable/disable schedule function 1050 allows a user to enable or disable the scheduled control of the sound masking volume. As indicated in block 1052, the user enters an enable or a disable speaker volume control schedule. In response to the user entry, the controller 230 (i.e. a function executed by the controller 230) disables or enables the speaker volume control schedule accordingly, as indicated by block 1054. Control returns to the calling program or to the top function level, i.e. block 1010.

The remove schedule entry function 1030 requires the user to enter information for identifying the schedule entry to be removed, for example, the day of the week and the time of day. As shown in block 1031, the user enters the day of the week in block 1031 and then in block 1032, the user enters the time of day. In response, a function or process executed by the controller 230 locates the identified schedule entry and deletes it, as indicated by block 1034. Next, a verification check can be made according to blocks 1028 and 1011 as described above.

The copy schedule entry function 1040 allows a user to copy a schedule entry to another day of the week. The user first enters the source day of the week schedule entry in block 1042. The user next enters the destination for the source day of the week schedule entry in block 1044. In response, the controller 230 (FIG. 2) executes a function to copy the source schedule entries to the destination day of week replacing any existing entries in the destination day of week, as indicated in block 1046. Next, a verification check can be made according to blocks 1028 and 1011 as described above, and control returns to the calling function or program.

Figure 11:
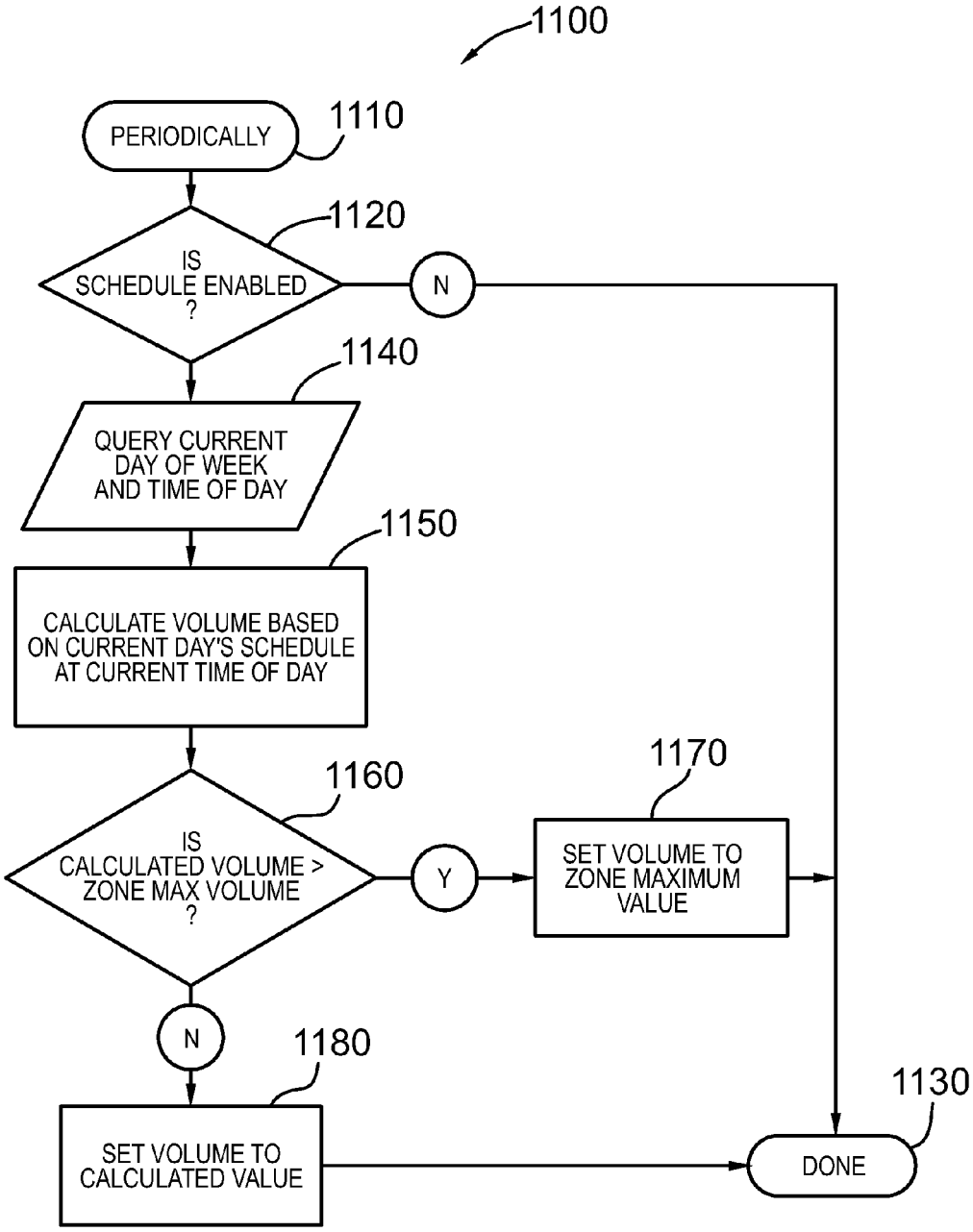
FIG. 11 shows in flowchart form a process for a speaker device for controlling the volume of a speaker based on a volume control schedule according to an embodiment.

Reference is next made to FIG. 11, which shows in flowchart form a process for controlling the scheduled speaker volume in conjunction with the centralized control of the sound masking system. The control process is indicated generally by reference 1100 and as indicated by block 1110 is executed periodically, for example, as part of a polling loop or a timer-based interrupt. The first operation involves a decision step 1120 to determine if the speaker volume control schedule is enabled. If the speaker volume control schedule is not enabled, then the control process 1100 terminates, i.e. returns to the calling program or function, as indicated by block 1130. If the speaker volume control schedule is enabled, then the current day of week and time of day is queried in block 1140 and the speaker volume is determined based on the schedule for the current day of the week and the current time of day in block 1150. Next in decision block 1160, the calculated speaker volume is compared to the maximum zone volume (i.e. as allowed by the central controller 110 in FIG. 1). If the calculated speaker volume is greater than the allowed maximum zone volume, the speaker volume is set to the maximum zone value in block 1170, and control returns to the calling program or function in block 1130. If the calculated speaker volume is less than the allowed maximum zone volume, the speaker volume is set to the calculated value in block 1180, and control returns to the calling program or function in block 1130.

Figure 12A:
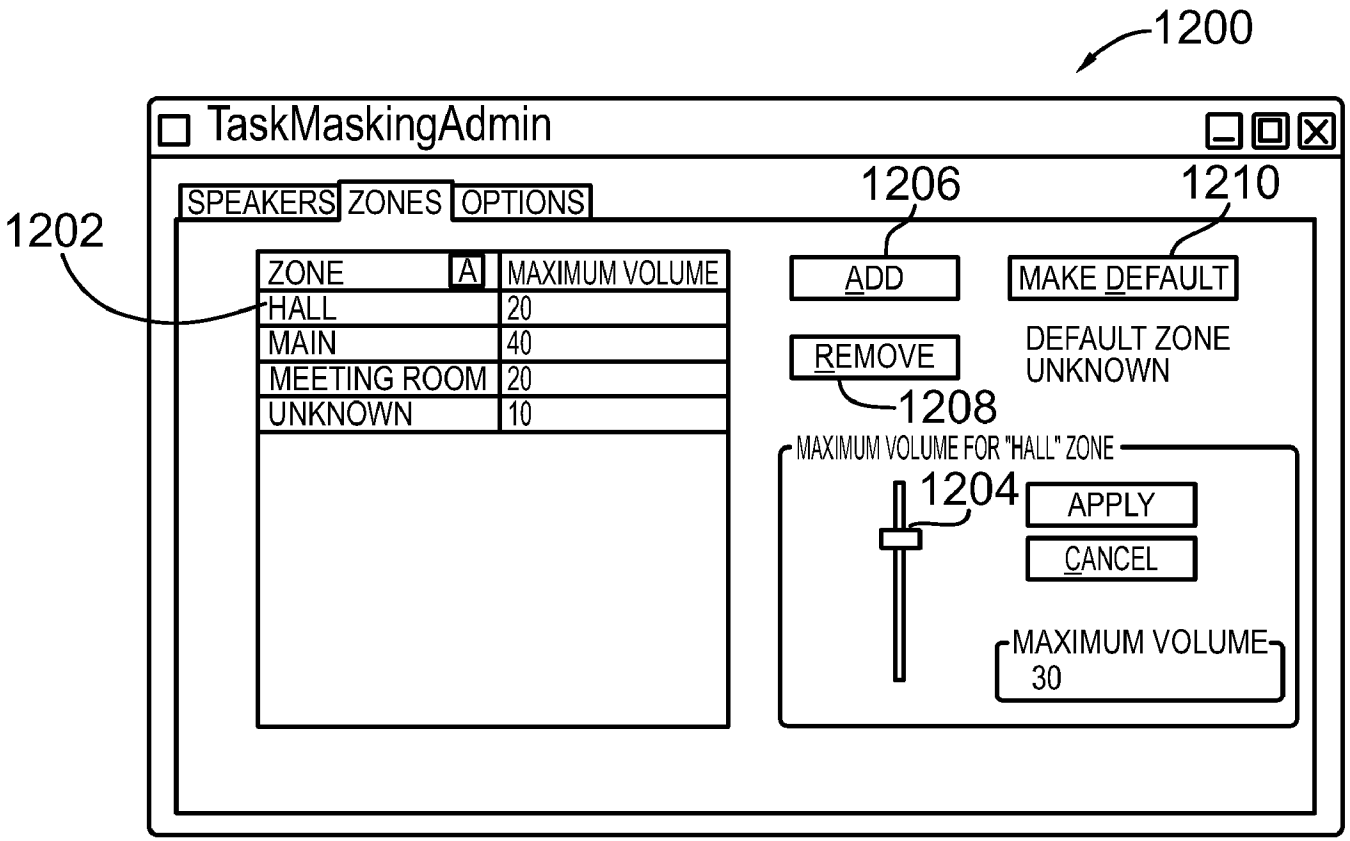
FIG. 12(*a*) shows a screen-shot of a window for a controller for administering zones in the sound masking system according to an embodiment.
Figure 12B:
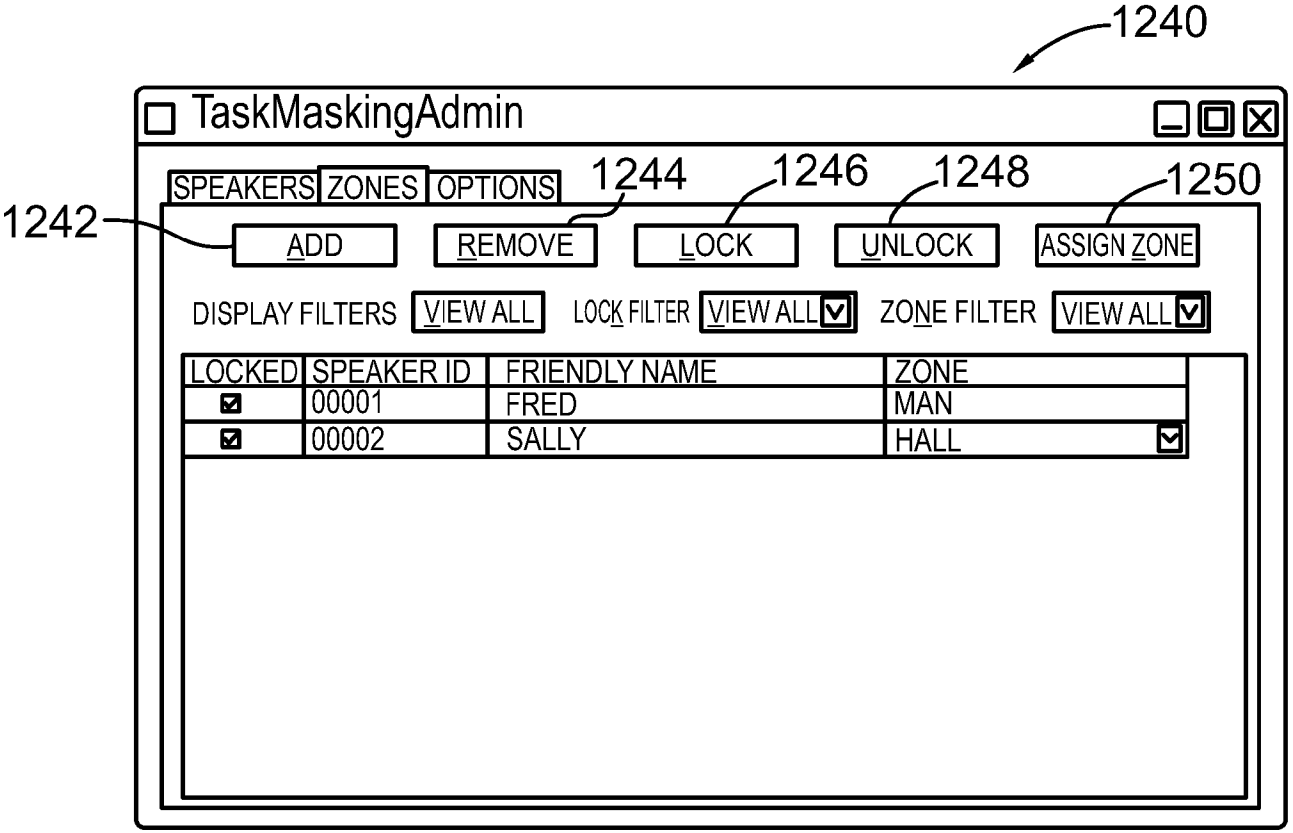
Figure 12C:
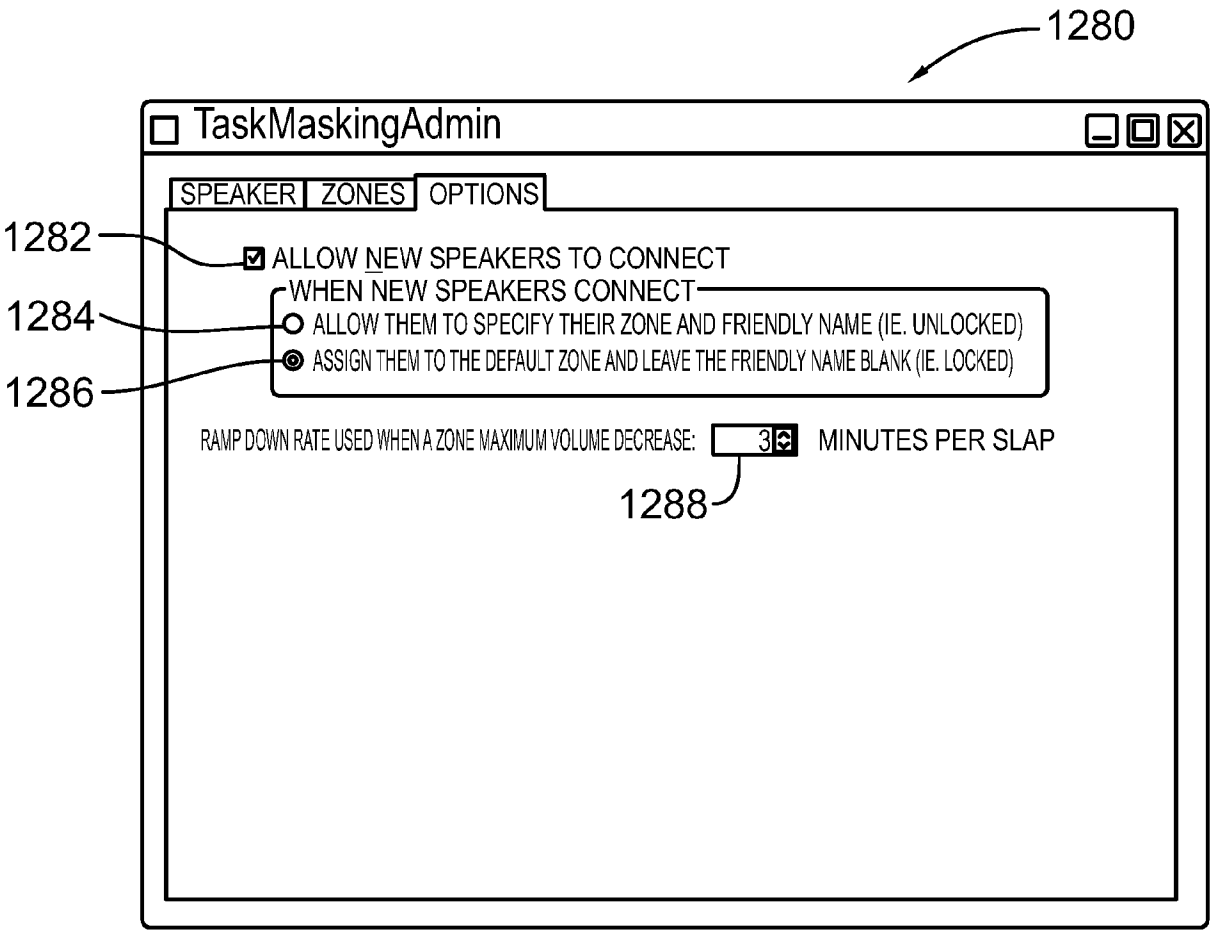
Figure 13A:
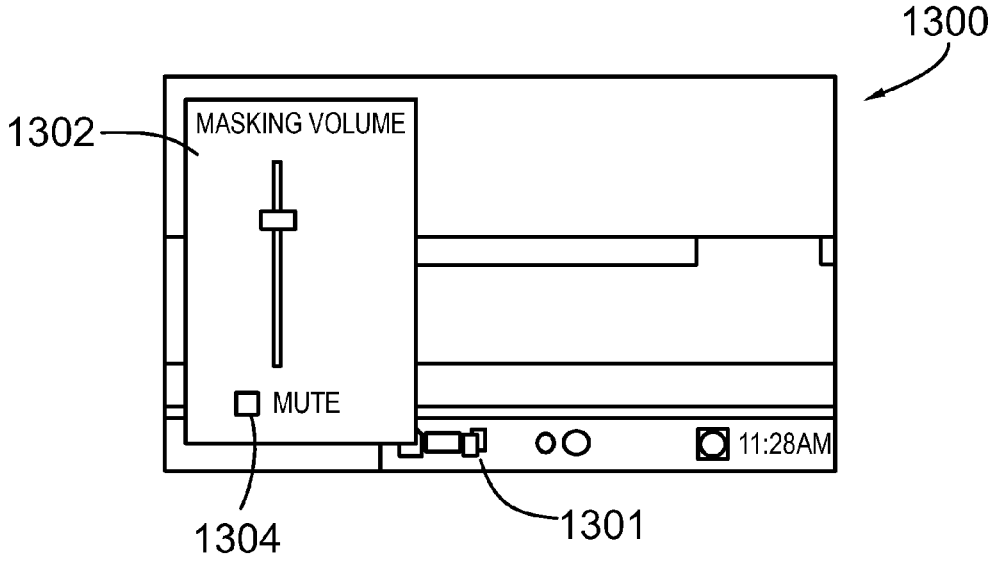
FIG. 13(*a*) is a screen-shot of a window for a speaker device for adjusting the masking volume according to an embodiment.
Figure 13B:
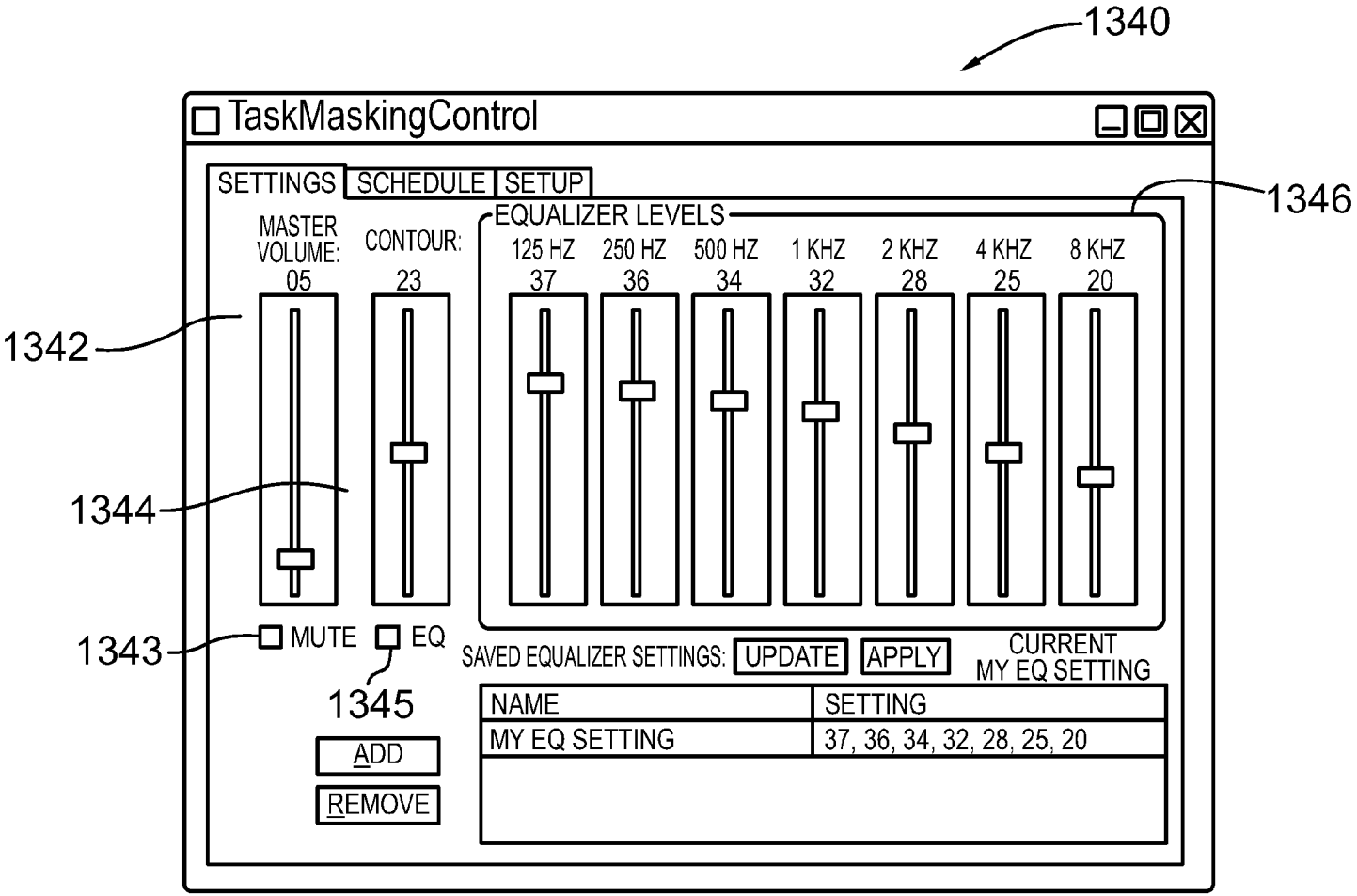
Figure 13C:
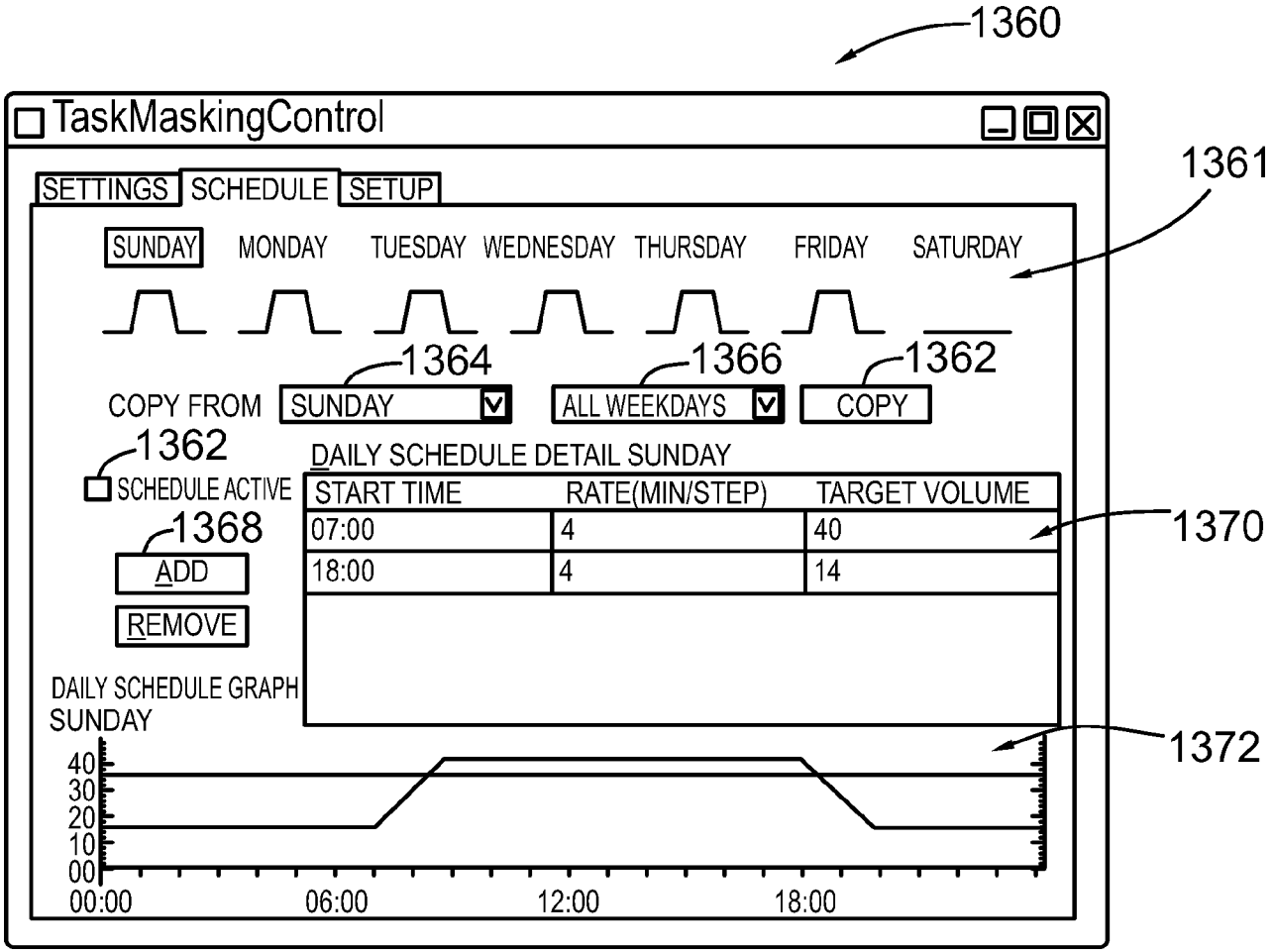
Figure 13D:
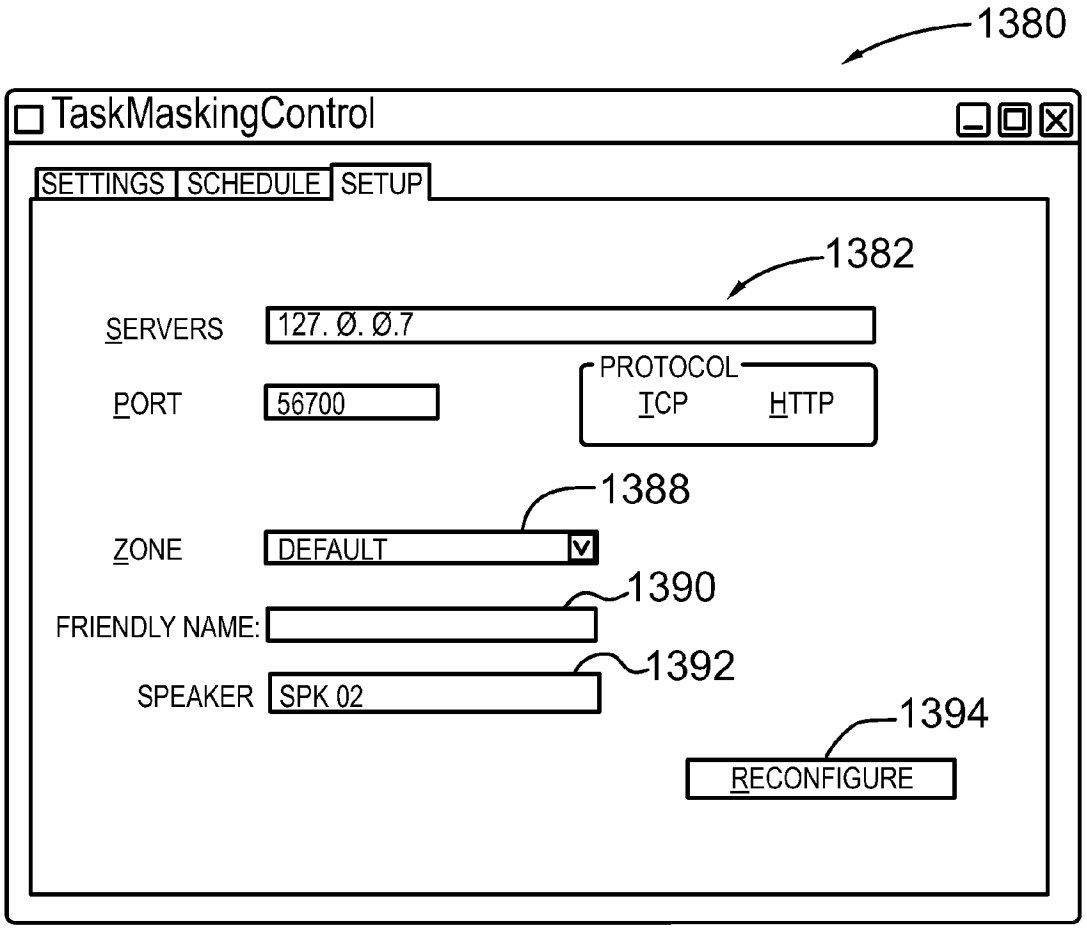

Reference is next made to FIGS. 12 and 13, which show screen-shots of an exemplary graphical user interface for implementing functions or operations as described above.

FIGS. 12(*a*) to 12(*c*) show screen-shots for administration functions accessed on the server side, i.e. through a centralized location, such as the central controller 110 of FIG. 1. The administration functions allow the administrator to control and override the settings made by a client or user in order to maintain overall control of the sound masking system 100, for example, as described above.

Reference is made to FIG. 12(*a*), which shows an administration screen indicated by reference 1200 for adding/removing zones from the sound masking system 100 (FIG. 1) and setting or adjusting the maximum sound masking volume for any of the zones in the sound masking system. As shown in FIG. 12(*a*), a zone is selected 1202, for example, the "Hall" zone, and a volume scale 1204 is used to set the maximum sound masking speaker volume for the "Hall" zone. As shown, the administration screen 1200 also includes a function button 1206 for adding a zone, a function button 1208 for removing a zone, and a function button 1210 for setting a default zone. The implementation of the graphical and functional elements of the graphical user interface for the administration screen 1200 will be within the understanding of one skilled in the art.

Reference is next made to FIG. 12(*b*), which shows a graphical user interface screen indicated by reference 1240 for administering the sound masking speakers in the sound masking system. As shown, the speaker administration screen 1240 includes a function button 1242 for adding a speaker, a function button 1244 for removing a speaker, a function button 1246 for locking a speaker, a function button 1248 for unlocking a speaker, and a function button 1250 for assigning a zone to a speaker. These functions are implemented to provide the functionality as described above, and the particular implementation of the graphical user interface elements for the administration screen 1240 will be within the understanding of one skilled in the art.

Reference is next made to FIG. 12(*c*), which shows a graphical user interface screen indicated by reference 1280 for setting options associated with the sound masking system. As shown, the options include allowing or not allowing new speakers to connect to the sound masking system, which may be implemented as a check box element 1282. The system options administration screen 1280 includes a select button 1284, which allows users of the new speakers to specify the zone for their speaker (for example, as described above with reference to FIG. 7). If the administrator does not set the select button 1284, then as indicated by button 1286 the user is limited to the default zone when connecting a new (i.e. previously unknown) speaker. The system options administration screen 1280 also includes an input box 1288 for setting a ramp down period for decreasing the maximum sound masking volume for the sound masking system.

FIGS. 13(*a*) to 13(*d*) show screen-shots of user, i.e. client control screens, as will be described in more detail below. The client control screens allow the user to control various functions of the sound masking module and are typically executed as part of the client software (i.e. the controller 230 of FIG. 2 or the controller 330 of FIG. 3) installed on the workstation computer.

Reference is made to FIG. 13(*a*), which shows a screen-shot for a client masking volume control window 1300, which may reside in the system tray in a Windows™ based software implementation. The volume control window 1300 includes a volume control button 1301 which is clicked to reveal a masking volume level adjust scale 1302. The volume control window 1302 can also include a speaker mute control implemented as a check box 1304.

According to another aspect, double clicking the icon in the Windows™ system tray displays a client settings control window 1340 as shown in FIG. 13(*b*). As shown, the client settings control window 1340 allows a client, i.e. user, to control, adjust or affect the output characteristics of the sound masking signal, and includes a master volume control 1342, a mute checkbox 1343, a contour control scale 1344, an EQ checkbox 1345 and an equalizer level control 1346. The contour and equalizer level controls operate, for example, as described above with reference to FIG. 8, and one or the other is selected by checking or un-checking the EQ checkbox 1345. The speaker volume and equalizer settings are subject to the maximum or override settings controlled by the administrator.

Reference is made to FIG. 13(*c*), which shows a screen-shot for a client schedule window indicated generally by reference 1360. For the embodiment depicted in FIG. 13(*c*), the client schedule window 1360 includes a days of the week and corresponding sound masking volume icons view 1361, a schedule activation button 1362, a copy function button 1363 and associated source and destination selection boxes 1364, 1366. The client schedule window 1360 allows a user to define and modify a schedule for controlling the volume of the sound masking speaker, for example, in a manner as described above with reference to FIG. 10. The client schedule window 1360 includes a button for adding a schedule entry 1368, for example, as described above with reference 10. The client schedule window 1360 may also include a daily schedule table 1370 and a daily schedule graph 1369. The daily schedule table 1370 displays the scheduled volume settings for a day of the week, and the day of week is selected by clicking an icon in the days of week view 1361, for example, the icon for "Sunday". The daily schedule graph 1369 shows the programmed volume settings for the selected day of the week, for example, "Sunday", in graphical form.

Reference is next made to FIG. 13(*d*), which shows a screen-shot for a client setup window indicated generally by reference 1380. The client setup window 1380 allows the user to select or configure setup parameters associated with the speaker. For the embodiment depicted in FIG. 13(*d*), the client setup screen 1380 allows the user to configure or define the zone for the speaker (i.e. using a zone configuration box 1388), and provide a user-friendly name for the speaker (i.e. using a "friendly name" box 1390). The friendly name function may be implemented in a manner similar to that for zone assignment described above. As shown, the client setup screen 1380 includes a "Reconfigure" button to make changes or select setup parameters, however, for the changes to take effect, the client (i.e. the controller 230 (FIG. 2) or 330 (FIG. 3) needs to be connected to the control unit 250 (FIG. 2)). The client setup screen 1380 includes server connection display boxes(s) indicated generally by reference 1382, which show the connection with the server (i.e. the central controller). For example, clicking the reconfigure button 1394 allows the user to enter a friendly name for the speaker in box 1390, and select a zone from the zone configuration (i.e. drop-down) box 1388, for example, as described above with reference to the speaker connection process of FIG. 7, and within any restrictions imposed or set by the administrator (i.e. the central controller or authority 110 in FIG. 1).

The present invention may be embodied in other specific forms without departing from spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A sound masking system for providing sound masking at a workstation for a user in a physical space, said sound masking system comprising:

a communication network spanning at least a portion of the space;

a plurality of sound masking devices, each of said sound masking devices being adapted to emit a sound masking signal in a user space, and one or more of said sound masking devices including a controller for controlling one or more output characteristics associated with said sound masking signal, a local interface comprising a client control graphical interface window configured with one or more user adjustable controls configured to control one or more of said output characteristics, and said user controls being responsive to actuation from the user for adjusting said user adjustable controls, and said controller further including a network interface configured for receiving network control messages from said communication network;

a control unit, said control unit including a component for affecting at least one of the output characteristics of said sound masking signal and said control unit having a network interface for transmitting said network control messages over said communication network; and said controller of at least one of said sound masking devices having a component responsive to said network control messages for adjusting said associated output characteristic.

2. The sound masking system as claimed in claim 1, wherein said user adjustable controls are configured to be adjustable over a range determined by said controller.

3. The sound masking system as claimed in claim 1, wherein said network control message overrides said user adjustments of said user controls.

4. The sound masking system as claimed in claim 1, wherein said controller includes an administration screen comprising one or more adjustable controls configured to control one or more of said plurality of sound masking devices and one or more of said output characteristics associated with said plurality of sound masking devices, and said adjustable controls being responsive to manipulation by an administrator.

5. The sound masking system as claimed in claim 4, wherein the physical space comprises a plurality of zones, and said administration screen comprises a zone administration screen, said zone administration screen includes one or more of an add zone control, a remove zone control and a zone volume setting control, configured to be responsive to actuation by the administrator.

6. The sound masking system as claimed in claim 4, wherein said administration screen comprises a speaker administration screen, said speaker administration screen includes one or more of an add speaker control, a remove speaker control, a speaker lock control, a speaker unlock control and a speaker zone assign control, and each of said controls being configured to be responsive to actuation by the administrator.

7. The sound masking system as claimed in claim 1, wherein said sound masking device and controller are configured for a computer at the workstation, and one or more of said workstations form one of said zones.

8. The sound masking system as claimed in claim 7, wherein said controller comprises a computer program, said computer program being executed by the computer, and said computer having a port for connecting said sound masking device.

9. The sound masking system as claimed in claim 8, wherein said control unit comprises a computer running a sound masking control program, and the output characteristic for said sound masking signal comprises a volume limit and said sound masking control program includes a component for setting a volume limit.

10. The sound masking system as claimed in claim 4, wherein said client control graphical interface window comprises a client masking volume control window, said client masking volume control window including a masking volume level adjust scale configured to be responsive to actuation by the user for setting a masking volume level.

11. The sound masking system as claimed in claim 4, wherein said client control graphical interface window comprises a client settings control window, said client settings control window including one or more of a master volume control, a mute control and a contour control scale, configured to be responsive to actuation by the user.

12. The sound masking system as claimed in claim 11, wherein said client settings control window includes an equalizer control and an equalizer level control, said equalizer control being configured to be responsive to an input from the user for enabling said equalizer level control and disabling said contour control scale.

13. The sound masking system as claimed in claim 4, wherein said client control graphical interface window comprises a client schedule window.

14. The sound masking system as claimed in claim 4, wherein said client control graphical interface window comprises a client setup window, said client setup window comprises one or more of a reconfigure button, a speaker name entry box, and a select zone box, configured to be responsive to actuation by the user.

15. A method for controlling a plurality of individual sound masking speakers, wherein each of said sound masking speakers is adapted to emit a sound masking signal having one or more output characteristics controllable by a user, said method comprising the steps of:

providing a local graphical user interface configured with one or more user controls responsive to actuation by the user for adjusting said user controls;

providing a communication network for coupling the sound masking speakers to a control unit;

providing said control unit with a local interface for receiving user adjusted controls;

generating output characteristic control information for the sound masking speakers;

providing a centralized controller with a communication interface for transmitting said output characteristic control information to one or more of the sound masking speakers;

applying one or more of said user adjusted controls;

providing the sound masking speakers with a component responsive to said one or more user adjusted controls;

providing the sound masking speakers with a component responsive for the output characteristic control information;

affecting the sound masking signal in response to said output characteristic control information.

16. The method as claimed in claim 15, wherein one or more of the sound masking speakers are arranged in one or more zones, and wherein said step of generating output characteristic control information comprises generating a volume control level for one or more of said zones.

17. The method as claimed in claim 15, further including the step of allowing the sound masking speakers to select one of said zones.

18. The method as claimed in claim 15, wherein said output characteristic is controllable by the user.

19. The method as claimed in claim 18, wherein said output characteristic comprises a contour setting for the sound masking signal.

20. The method as claimed in claim 19, wherein said output characteristic comprises an equalizer setting for the sound masking signal.

21. A sound masking module for providing sound masking at a user workstation, said sound masking module comprising:

a sound masking unit configured for emitting a sound masking signal at the workstation;

a local interface comprising a client control graphical interface window configured with one or more user adjustable controls and said user controls being responsive to inputs from the user for adjusting said user controls;

a network interface configured for receiving network control messages from a controller, wherein said control messages comprise centralized control messages intended for a plurality of sound masking modules configured in a network;

wherein said sound masking unit includes a component configured to be responsive to said user controls as adjusted by the user for controlling one or more characteristics associated with said sound masking signal; and wherein said sound masking unit includes a component configured to be responsive to said network control messages for controlling one or more characteristics associated with said sound masking signal.

22. The sound masking module as claimed in claim 21, wherein said user adjustable controls are configured to be adjustable over a range determined by said controller.

23. The sound masking module as claimed in claim 21, wherein said network control message overrides said user adjustments of said user controls.

24. The sound masking module as claimed in claim 22, wherein said client control graphical interface window comprises a client masking volume control window, said client masking volume control window including a masking volume level adjust scale configured to be responsive to actuation by the user for setting a masking volume level.

25. The sound masking module as claimed in claim 22, wherein said client control graphical interface window comprises a client settings control window, said client settings control window including one or more of a master volume control, a mute control and a contour control scale, configured to be responsive to actuation by the user.

26. The sound masking module as claimed in claim 25, wherein said client settings control window includes an equalizer control and an equalizer level control, said equalizer control being configured to be responsive to an input from the user for enabling said equalizer level control and disabling said contour control scale.

27. The sound masking module as claimed in claim 22, wherein said client control graphical interface window comprises a client schedule window.

28. The sound masking module as claimed in claim 22, wherein said client control graphical interface window comprises a client setup window, said client setup window comprises one or more of a reconfigure button, a speaker name entry box, and a select zone box, configured to be responsive to actuation by the user.

* * * * *